US011925973B2

(12) United States Patent
Wagstaff et al.

(10) Patent No.: US 11,925,973 B2
(45) Date of Patent: Mar. 12, 2024

(54) REDUCED FINAL GRAIN SIZE OF UNRECRYSTALLIZED WROUGHT MATERIAL PRODUCED VIA THE DIRECT CHILL (DC) ROUTE

(71) Applicant: Novelis, Inc., Atlanta, GA (US)

(72) Inventors: Samuel Robert Wagstaff, Marietta, GA (US); Robert Bruce Wagstaff, Greenacres, WA (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 17/757,665

(22) PCT Filed: Dec. 18, 2020

(86) PCT No.: PCT/US2020/065922

§ 371 (c)(1),
(2) Date: Jun. 17, 2022

(87) PCT Pub. No.: WO2021/127380

PCT Pub. Date: Jun. 24, 2021

(65) Prior Publication Data

US 2022/0339694 A1 Oct. 27, 2022

Related U.S. Application Data

(60) Provisional application No. 62/951,884, filed on Dec. 20, 2019.

(51) Int. Cl.
*B22D 11/049* (2006.01)
*B22D 11/00* (2006.01)
(Continued)

(52) U.S. Cl.
CPC ..... *B22D 11/049* (2013.01); *B22D 11/003* (2013.01); *B22D 11/112* (2013.01); *B22D 11/124* (2013.01); *B22D 11/22* (2013.01)

(58) Field of Classification Search
CPC ..... B22D 11/00; B22D 11/003; B22D 11/049; B22D 11/112; B22D 11/124; B22D 11/22
(Continued)

(56) References Cited

U.S. PATENT DOCUMENTS 4,237,961 A 12/1980 Zinniger
8,813,827 B2 8/2014 Fenton et al.
(Continued)

FOREIGN PATENT DOCUMENTS

CN 1107397 A 8/1995
EP 2682201 1/2014
(Continued)

OTHER PUBLICATIONS

IN202217034847 , "First Examination Report", dated Nov. 16, 2022, 8 pages.
(Continued)

*Primary Examiner* — Kevin P Kerns
(74) *Attorney, Agent, or Firm* — Kilpatrick Townsend & Stockton LLP

(57) ABSTRACT

Grain size of a deliverable metal product can be improved by pre-setting recrystallization-suppressing dispersoids during casting. The outer regions of a direct chill cast embryonic ingot can undergo reheating before casting is complete. Through unique wiper placement and/or other reheating techniques, the temperature of the ingot can be permitted to reheat (e.g., up to approximately 410° C. to approximately 420° C.), allowing dispersoids to form. Stirring and/or agitation of the molten sump can facilitate formation of a deeper sump and desirably fine grain size as-cast. The formation of dispersoids during and/or immediately after casting can pin the grain boundaries at the desirably fine grain size, encouraging the same grain sizes even after a later recrystallization and/or solutionizing step.

23 Claims, 10 Drawing Sheets

(51) Int. Cl.
*B22D 11/112* (2006.01)
*B22D 11/124* (2006.01)
*B22D 11/22* (2006.01)

(58) Field of Classification Search
USPC ..... 164/444, 486, 487
See application file for complete search history.

(56) References Cited

U.S. PATENT DOCUMENTS

| | | | | |
|---|---|---|---|---|
| 2008/0179038 | A1* | 7/2008 | Park et al. ..... | B22D 11/001 164/466 |
| 2015/0336165 | A1 | 11/2015 | Wagstaff et al. | |
| 2017/0216908 | A1 | 8/2017 | Brugger et al. | |
| 2017/0274446 | A1 | 9/2017 | Wagstaff | |

FOREIGN PATENT DOCUMENTS

| | | | |
|---|---|---|---|
| EP | 3453472 | | 3/2019 |
| JP | 2009513357 | A | 4/2009 |
| JP | 2017515687 | | 6/2017 |
| KR | 20140139007 | A | 12/2014 |
| KR | 20170005469 | A | 1/2017 |

OTHER PUBLICATIONS

El-Bealy , "Interdendritic Strain and Macrosegregation-Coupled Phenomena for Interdendritic Crack Formation in Direct-Chill Cast Sheet Ingots", Metallurgical and Materials Transactions B, vol. 43, No. 3, Dec. 2011, pp. 635-656.
Application No. PCT/US2020/065922 , International Search Report and Written Opinion, dated Feb. 22, 2021, 19 pages.
CA3,162,706 , "Office Action", dated Apr. 4, 2023, 4 pages.
EP20842122.2 , "Intention to Grant", dated Apr. 28, 2023, 7 pages.
JP2022-537547 , "Office Action", dated Apr. 4, 2023, 7 pages.
RU2022118612 , "Office Action", dated Mar. 1, 2023, 22 pages.
EP20842122.2 , "Intention to Grant", dated Aug. 23, 2023, 8 pages.
KR10-2022-7019439 , "Office Action", dated Aug. 14, 2023, 5 pages.
JP2022-537547 , "Notice of Decision to Grant", dated Sep. 26, 2023, 3 pages.

* cited by examiner

REDUCED FINAL GRAIN SIZE OF UNRECRYSTALLIZED WROUGHT MATERIAL PRODUCED VIA THE DIRECT CHILL (DC) ROUTE

CROSS-REFERENCE TO RELATED APPLICATIONS

This application is a national stage application, filed under 35 U.S.C. § 371, of International Patent Application No. PCT/US2020/065922, filed on Dec. 18, 2020, which claims the benefit of and priority to U.S. Provisional Application No. 62/951,884, filed on Dec. 20, 2019, which are hereby incorporated by reference in their entireties.

FIELD

The present disclosure relates to metal casting generally and more specifically to direct chill casting difficult aluminum alloys.

BACKGROUND

In direct chill (DC) casting, molten metal is passed into a mold cavity with a false, or moving, bottom. As the molten metal enters the mold cavity, generally from the top, the false bottom lowers at a rate related to the rate of flow of the molten metal. The molten metal that has solidified near the sides can be used to retain the liquid and partially liquid metal in the molten sump. The metal can be 99.9% solid (e.g., fully solid), 100% liquid, and anywhere in between. The molten sump can take on a V-shape, U-shape, or W-shape, due to the increasing thickness of the solid regions as the molten metal cools. The interface between the solid and liquid metal is sometimes referred to as the solidifying interface.

As the molten metal in the molten sump becomes between approximately 0% solid and approximately 5% solid, nucleation can occur and small crystals of the metal can form. These small (e.g., nanometer size) crystals begin to form as nuclei, which continue to grow in preferential directions to form dendrites as the molten metal cools. As the molten metal cools to the dendrite coherency point (e.g., 632° C. in 5182 aluminum used for beverage can ends), the dendrites begin to stick together. Depending on the temperature and percent solid of the molten metal, crystals can include or trap different particles (e.g., intermetallics or hydrogen bubbles), such as particles of $FeAl_6$, $Mg_2Si$, $FeAl_3$, $Al_8Mg_5$, and gaseous $H_2$, in certain alloys of aluminum.

Additionally, as the solidifying aluminum first starts to cool, it cannot support as much alloying element in its alpha phase, and thus the molten metal surrounding the solidifying interface may have a proportionally higher concentration of alloying elements. Different compositions and particles can thus form at or near the solidifying interface. Additionally, there can be stagnation regions within the sump, which can lead to preferential accumulation of these particles.

The inhomogeneous distribution of alloying elements on the length scale of a grain is known as microsegregation. In contrast, macrosegregation is the chemical inhomogeneity over a length scale larger than a grain (or number of grains), such as up to the length scale of meters.

Certain aluminum alloys, such as 7xxx series alloys, can be especially difficult to cast. 7xxx series alloys generally contain numerous alloying elements, such as combinations of one or more of zinc, magnesium, copper, chromium, zirconium, and other alloying elements. When casting 7xxx series alloys and immediately thereafter, large internal stresses (e.g., compressive and sometimes tensile stresses) can build up, rendering the cast article prone to cracking. Certain alloying elements used in these types of alloys, such as zinc, contract and expand at a much different rate than Aluminum. In particular, zinc contracts and expands significantly more than Aluminum. Thus, identical volumes of zinc and aluminum at similar temperatures (e.g., 600° C.) may result in different volumes each of zinc and aluminum when cooled (e.g., in the final stages of solidification). These varying rates of expansion and contraction between the alloying elements and the Aluminum can be a cause of the large internal forces, and thus stresses, within an article cast from a 7xxx series alloy.

Additionally, 7xxx series alloys are highly susceptible to porosity issues resulting from dissolved hydrogen being rejected from the solidifying molten alloy as micro bubbles of gas. The voids caused by the bubbles of gas are often crack initiation sites and can lead to substantial cracking. Additionally, 7xxx series alloys can be highly susceptible to shrinkage porosity due at least in part to the difference in shrinkage percentages as the molten metal solidifies.

In traditional production environments, the large internal stresses during solidification can cause hot cracking or cold cracking in a cast article, rendering the article unsuitable for further production. With 7xxx series alloys, traditional production environments incur increased whole ingot losses as compared to other, more easily cast articles, such as 6xxx series alloys.

Additionally, 7xxx series alloy cast articles can rely on a prolonged homogenization step after casting to achieve a desired internal structure with desired precipitates while reducing the as cast stresses. Homogenization can be used to reduce microsegregation after casting. In some cases, 7xxx series alloy cast articles can be hot-rolled to a smaller gauge, solutionized, and then aged. In some cases, long periods of aging and further treatment (e.g., solutionizing or recrystallization) can be used to try and obtain more desirable microstructures, but such techniques require substantial equipment and substantial expenditures of time, resources, and energy.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Embodiments of the present disclosure include a casting method, comprising: supplying molten metal to a casting mold and forming an embryonic ingot comprising an external solid shell and an internal molten core; advancing the embryonic ingot in a direction of advancement away from the casting mold while supplying additional molten metal to the casting mold; extracting heat from the embryonic ingot between the casting mold and a transition location by directing a supply of liquid coolant to an outer surface of the external solid shell; and reheating the embryonic ingot at the transition location such that at least a portion of the external solid shell of the embryonic ingot at the transition location reaches a temperature (e.g., reheating temperature) suitable for precipitating dispersoids and lower than a homogenizing temperature of the molten metal, wherein the transition location lies in a plane that is perpendicular to the direction of advancement and that intersects the internal molten core.

In some cases, the reheating temperature, such as in Celsius, is between 80% and 98% of the homogenizing temperature, such as in Celsius, of the molten metal. In some cases, the temperature, such as in Celsius, is between 85% and 90% of the homogenizing temperature, such as in Celsius, of the molten metal. Optionally, the temperature in Celsius is from 80% to 95%, from 80% to 90%, from 80% to 85%, 80%, 81%, 82%, 83%, 84%, 85%, 86%, 87%, 88%, 89%, 90%, 91%, 92%, 93%, 94%, 95%, 96%, 97%, or 98% of the homogenizing temperature in Celsius of the molten metal. In some cases, the temperature is between 400° C. and 460° C. In some cases, the temperature is between 410° C. and 420° C. Optionally, the temperature is from 400° C. to 410° C., from 400° C. to 420° C., from 400° C. to 430° C. from 400° C. to 440° C. from 400° C. to 450° C. from 400° C. to 460° C. from 410° C. to 420° C. from 410° C. to 430° C. from 410° C. to 440° C., from 410° C. to 450° C., from 410° C. to 460° C., from 420° C. to 430° C., from 420° C. to 440° C., from 420° C. to 450° C., from 420° C. to 460° C., from 430° C. to 440° C., from 430° C. to 450° C., from 430° C. to 460° C., from 440° C. to 450° C., from 440° C. to 460° C., or from 450° C. to 460° C. In some cases, the method further comprises maintaining the temperature at the portion of the external solid shell for at least 3 hours, such as from 3 hours to 4 hours, from 3 hours to 5 hours, from 3 hours to 6 hours, from 3 hours to 7 hours, from 3 hours to 8 hours, from 3 hours to 9 hours, from 3 hours to 10 hours, from 4 hours to 5 hours, from 4 hours to 6 hours, from 4 hours to 7 hours, from 4 hours to 8 hours, from 4 hours to 9 hours, from 4 hours to 10 hours, from 5 hours to 6 hours, from 5 hours to 7 hours, from 5 hours to 8 hours, from 5 hours to 9 hours, from 5 hours to 10 hours, from 6 hours to 7 hours, from 6 hours to 8 hours, from 6 hours to 9 hours, from 6 hours to 10 hours, from 7 hours to 8 hours, from 7 hours to 9 hours, from 7 hours to 10 hours, from 8 hours to 9 hours, from 8 hours to 10 hours, from 9 hours to 10 hours or more. In some cases, reheating the embryonic ingot comprises removing the liquid coolant from the outer surface of the external solid shell. In some cases, reheating the embryonic ingot further comprises applying heat to the outer surface of the external solid shell to supplement latent heating from the internal molten core. In some cases, the method further comprises taking temperature measurements of the embryonic ingot; and dynamically adjusting the transition location based on the temperature measurements. In some cases, the method further comprises inducing stirring in the internal molten core adjacent an interface between the internal molten core and the external solid shell. In some cases, the method further comprises taking temperature measurements of the embryonic ingot, wherein inducing stirring in the internal molten core comprises dynamically adjusting an intensity of stirring based on the temperature measurements. In some cases, the transition location is selected such that the plane intersects the embryonic ingot at a cross section where the external solid shell of the embryonic ingot occupies approximately one third of a line extending from the outer surface to a center of the embryonic ingot within the plane. In some cases, the transition location is selected such that the plane intersects the embryonic ingot at a cross section where the external solid shell of the embryonic ingot occupies no more than 50% of a line extending from the outer surface to a center of the embryonic ingot within the plane. In some cases, the molten metal is a 7xxx series aluminum alloy. In some cases, the reheated portion comprises a plane of metal, containing liquid in the center, with a re-heating zone growing said precipitates around the periphery of the ingot adjacent the surface.

Embodiments of the present disclosure include a method, comprising: forming an embryonic ingot by supplying molten metal to a mold and extracting heat from the molten metal to form an external solid shell; solidifying an internal molten core of the embryonic ingot as the embryonic ingot is advanced in a direction of advancement away from the mold and additional molten metal is supplied to the mold, wherein solidifying the internal molten core comprises extracting heat from the internal molten core through the external solid shell; and continuously forming a high-strength zone within the external solid shell at a cross section of the embryonic ingot that is perpendicular to the direction of advancement and that intersects the internal molten core, wherein the high-strength zone is located between an outer surface of the external solid shell and the internal molten core, and wherein forming the high-strength zone includes reheating the external solid shell at the cross section to induce dispersoid precipitation in the external solid shell.

In some cases, reheating the external solid shell at the cross section comprises reheating a portion of the external solid shell to a temperature suitable for precipitating dispersoids, wherein the temperature is lower than a homogenizing temperature of the molten metal. In some cases, the temperature, such as in Celsius, is between 80% and 98% of the homogenizing temperature, such as in Celsius, of the molten metal. In some cases, the temperature, such as in Celsius, is between 85% and 90% of the homogenizing temperature, such as in Celsius, of the molten metal. In some cases, the temperature is between 300° C. and 460° C., such as between 400° C. and 460° C. In some cases, the temperature is between 410° C. and 420° C. In some cases, the temperature ranges of 400° C. to 460° C. and 410° C. to 420° C. can be especially suitable for 7xxx series alloys. In some cases, other temperature ranges can be used, such as with 6xxx series alloys. In some cases, the method further comprises maintaining the temperature at the portion of the external solid shell for at least 3 hours or from 3 hours to 10 hours. In some cases, extracting heat from the internal molten core through the external solid shell comprises supplying liquid coolant to the outer surface of the external shell, and wherein reheating the external solid shell comprises removing the liquid coolant from the outer surface of the external solid shell. In some cases, reheating the external solid shell further comprises applying heat to the outer surface of the external solid shell to supplement latent heating from the internal molten core. In some cases, the method further comprises taking temperature measurements of the embryonic ingot; and dynamically adjusting a distance between the mold and the cross section based on the temperature measurements. In some cases, the method further comprises inducing stirring in the internal molten core adjacent an interface between the internal molten core and the external solid shell. In some cases, the method further comprises taking temperature measurements of the embryonic ingot, wherein inducing stirring in the internal molten core comprises dynamically adjusting an intensity of stirring based on the temperature measurements. In some cases, at the cross section, the external solid shell of the embryonic ingot occupies approximately one third of a line extending from the outer surface to a center of the embryonic ingot. In some cases, at the cross section, the external solid shell of the embryonic ingot occupies no more than 50% of a line extending from the outer surface to a center of the embryonic ingot. In some cases, the molten metal is a 7xxx series aluminum alloy. In some cases, the high-strength zone includes a higher concentration of dispersoids than a remainder of the external solid shell.

Embodiments of the present disclosure include an aluminum metal product, comprising: a mass of solidified aluminum alloy having two ends and an outer surface, wherein the mass of solidified aluminum alloy comprises: a core region containing a center of the mass of solidified aluminum alloy; an outer region incorporating the outer surface; and a high-strength zone disposed between the core region and the outer region, wherein the high-strength zone has a higher concentration of dispersoids than each of the core region and the outer region.

In some cases, the mass of solidified aluminum alloy comprises retained heat from a direct chill casting process. In some cases, the high-strength zone is located at a depth of approximately one third of a line extending from the outer surface to the center of the mass of solidified aluminum alloy along a cross section of the mass of solidified aluminum alloy. In some cases, the high-strength zone is located at a depth of no more than one half of a line extending from the outer surface to the center of the mass of solidified aluminum alloy along a cross section of the mass of solidified aluminum alloy. In some cases, the mass of solidified aluminum alloy is cylindrical in shape. In some cases, a cross section of the mass of solidified aluminum alloy that is perpendicular to a direction of casting of the mass of solidified aluminum alloy is rectangular in shape. In some cases, the mass of solidified aluminum alloy is a mass of solidified series 7xxx aluminum alloy.

Embodiments of the present disclosure include an embryonic ingot, comprising: a liquid molten core of aluminum alloy extending from an upper surface to a solidifying interface; and a solidified shell of the aluminum alloy, the solidified shell comprising an outer surface extending from the solidifying interface to a bottom end in a casting direction, wherein the solidified shell comprises a high-strength zone disposed between the outer surface and a centerline extending in the casting direction through a center of the liquid molten core and a center of the solidified shell, wherein the high-strength zone has a higher concentration of dispersoids than a remainder of the solidified shell.

In some cases, the high-strength zone is located at a depth of approximately one third of a line extending from the outer surface to the centerline. In some cases, the high-strength zone is located at a depth of no more than one half of a line extending from the outer surface to the centerline. In some cases, the solidified shell is cylindrical in shape. In some cases, a cross section of the solidified shell that is perpendicular to the casting direction is rectangular in shape. In some cases, the aluminum alloy is a series 7xxx aluminum alloy. In some cases, the embryonic ingot is made according to any of the aforementioned methods.

Embodiments of the present disclosure include a method, comprising: delivering molten metal from a metal source to a metal sump of an embryonic ingot being cast in a mold; forming an external solid shell of solidified metal by extracting heat from the metal sump, wherein a solidifying interface is located between the external solid shell and the metal sump; advancing the embryonic ingot in a direction of advancement away from the mold at a casting speed while delivering the molten metal and forming the external solid shell; determining an intensity of stirring using the casting speed, wherein the intensity of stirring is suitable to achieve a target solidification interface profile at the casting speed; and inducing stirring within the molten sump at the determined intensity, wherein inducing stirring within the molten sump induces the solidification interface to take on the target solidification interface profile at the casting speed.

In some cases, inducing stirring comprises applying stirring forces to the molten metal in the metal sump using a non-contact magnetic stirrer. In some cases, delivering molten metal comprises delivering molten metal at a mass flow rate through a plurality of nozzles, and wherein inducing stirring comprises increasing a flow rate of molten metal through at least one of the plurality of nozzles while maintaining the mass flow rate through the plurality of nozzles. In some cases, the method further comprises modifying the casting speed; determining an updated intensity of stirring using the updated casting speed, wherein the updated intensity of stirring is suitable to achieve the target solidification profile at the updated casting speed; and inducing stirring within the molten sump at the updated intensity, wherein inducing stirring within the molten sump at the updated intensity induces the solidification interface to take on the target solidification interface profile at the updated casting speed. In some cases, the molten metal is a 7xxx series aluminum alloy. In some cases, the method further comprises measuring a temperature of the embryonic ingot, wherein determining the intensity of stirring using the casting speed comprises using the measured temperature. In some cases, the target solidification interface profile is predetermined to minimize a risk of cracking. In some cases, the method further comprises continuously forming a high-strength zone within the external solid shell at a cross section of the embryonic ingot that is perpendicular to the direction of advancement and that intersects the internal molten core, wherein the high-strength zone is located between an outer surface of the external solid shell and the internal molten core, and wherein forming the high-strength zone includes reheating the external solid shell at the cross section to induce dispersoid precipitation in the external solid shell. In some cases, inducing stirring within the molten sump comprises controlling delivery of the molten metal into the metal sump such that a jet of molten metal erodes a depression into the solidifying interface at a bottom of the metal sump, the depression having a diameter sized to match a diameter of the bottom of the metal sump.

Embodiments of the present disclosure include a method, comprising: delivering molten metal from a metal source to a metal sump of an embryonic ingot being cast in a mold; forming an external solid shell of solidified metal by extracting heat from the metal sump, wherein a solidifying interface is located between the external solid shell and the metal sump; advancing the embryonic ingot in a direction of advancement away from the mold at a casting speed while delivering the molten metal and forming the external solid shell; and controlling delivery of the molten metal into the metal sump to generate a jet of molten metal sufficient to erode at least a portion of the solidifying interface at a bottom of the metal sump.

In some cases, controlling delivery of the molten metal comprises controlling delivery of the molten metal such that the jet of molten metal erodes the solidifying interface to a thickness that is at or less than 10 mm. In some cases, delivering the molten metal comprises delivering the molten metal at a mass flow rate through a plurality of nozzles, and wherein generating the jet of molten metal comprises increasing a flow rate of molten metal through at least one of the plurality of nozzles while maintaining the mass flow rate through the plurality of nozzles. In some cases, the method further comprises applying stirring forces to the molten metal in the metal sump using a non-contact magnetic stirrer. In some cases, the method further comprises modifying the casting speed, wherein controlling delivery of the molten metal includes dynamically adjusting delivery of the molten metal based on the modified casting speed such that the jet of molten metal continues to erode at least the portion of the solidifying interface at the bottom of the metal sump. In some cases, the molten metal is a 7xxx series aluminum alloy. In some cases, the method further comprises measuring a temperature of the embryonic ingot, wherein controlling delivery of the molten metal comprises dynamically adjusting delivery of the molten metal based on the measured temperature such that the jet of molten metal continues to erode at least the portion of the solidifying interface at the bottom of the metal sump. In some cases, the method further comprises continuously forming a high-strength zone within the external solid shell at a cross section of the embryonic ingot that is perpendicular to the direction of advancement and that intersects the metal sump, wherein the high-strength zone is located between an outer surface of the external solid shell and the metal sump, and wherein forming the high-strength zone comprises reheating the external solid shell at the cross section to induce dispersoid precipitation in the external solid shell.

Embodiments of the present disclosure include an embryonic ingot, comprising: a solidified shell of aluminum alloy extending from a solidifying interface to a bottom end in a casting direction; and a liquid molten core of the aluminum alloy extending from an upper surface to the solidifying interface, wherein the liquid molten core includes a jet of the aluminum alloy impinging the solidifying interface at a bottom of the liquid molten core to form a depression in the solidifying interface.

In some cases, the liquid molten core includes re-suspended grains from the solidifying interface. In some cases, the liquid molten core includes re-suspended hydrogen from the solidifying interface. In some cases, the solidified shell comprises a high-strength zone disposed between an outer surface of the solidified shell and a centerline extending in the casting direction through a center of the liquid molten core and a center of the solidified shell, wherein the high-strength zone has a higher concentration of dispersoids than a remainder of the solidified shell. In some cases, the aluminum alloy is a series 7xxx aluminum alloy.

Embodiments of the present disclosure include an aluminum metal product made according to any of the methods described above.

Other objects and advantages will be apparent from the following detailed description of non-limiting examples.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
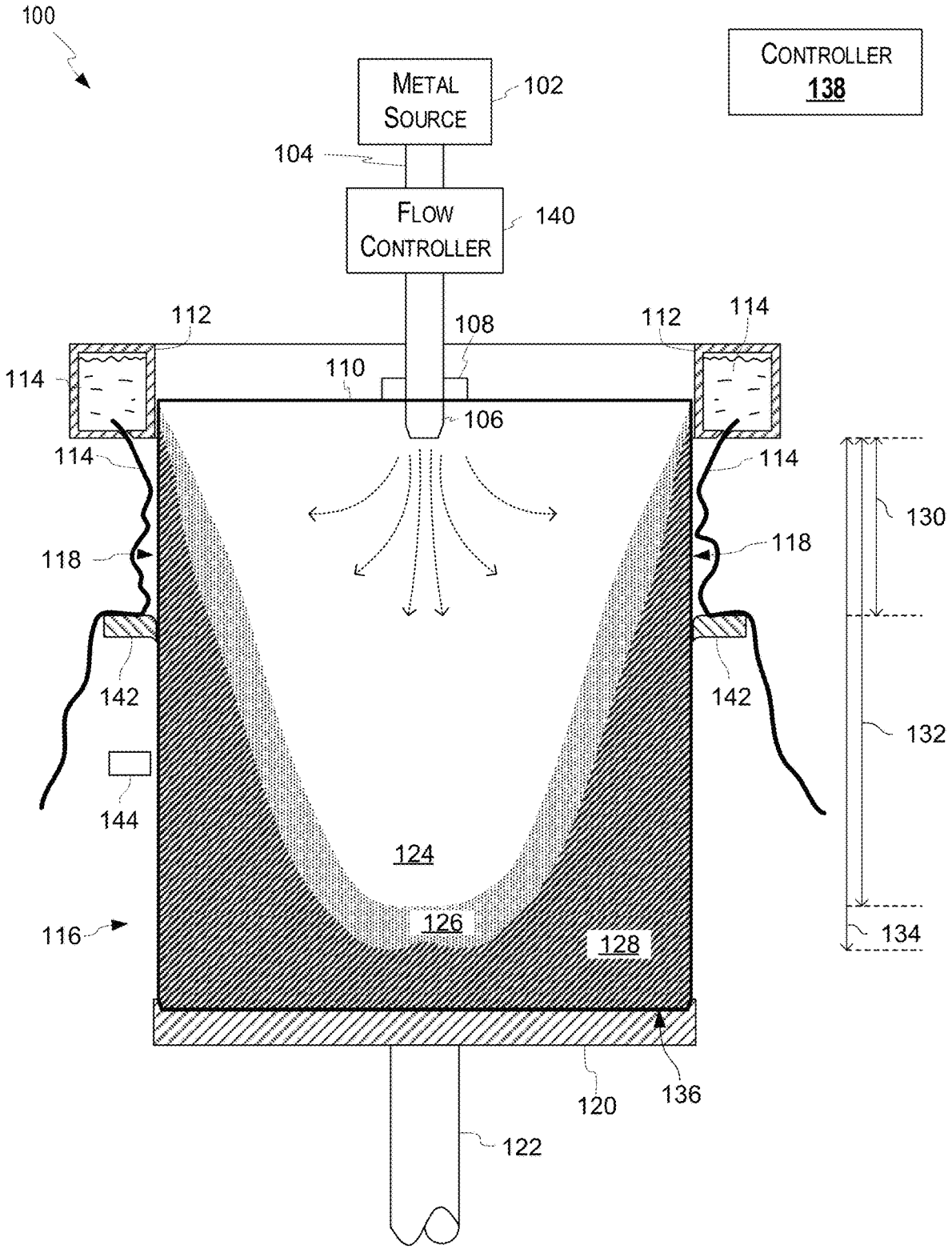
FIG. 1 is a partial cut-away view of a metal casting system for in-situ dispersoid precipitation according to certain aspects of the present disclosure.

Certain aspects and features of the present disclosure relate to improving grain size of a deliverable metal product by pre-setting recrystallization-suppressing dispersoids during casting. The outer regions of a direct chill cast embryonic ingot can undergo reheating before casting is complete. Through unique wiper placement and/or other reheating techniques, the temperature of the ingot can be permitted to reheat (e.g., up to approximately 410° C. to approximately 420° C.), allowing dispersoids to form. Stirring and/or agitation of the molten sump can facilitate formation of a deeper sump and desirably fine grain size as-cast. The formation of dispersoids during and/or immediately after casting can pin the grain boundaries at the desirably fine grain size, encouraging the same grain sizes even after a later recrystallization and/or solutionizing step.

In direct chill (DC) casting, molten metal is passed into a mold cavity with a false, or moving, bottom. As the molten metal enters the mold cavity, generally from the top, the false bottom lowers at a rate related to the rate of flow of the molten metal. The molten metal that has solidified near the sides can be used to retain the liquid and partially liquid metal in the molten sump. The metal can be 99.9% solid (e.g., fully solid), 100% liquid, and anywhere in between. The molten sump can take on a V-shape, U-shape, or W-shape, due to the increasing thickness of the solid regions as the molten metal cools. The interface between the solid and liquid metal is sometimes referred to as the solidifying interface or solidification front. The metal article resulting from the DC cast process can be referred to as an ingot. An ingot may have a generally rectangular cross section, although other cross sections can be used, such as circular or even non-symmetric. The term ingot, as used herein, can be inclusive of any DC cast metal article, including billets, as appropriate.

As described above, as metal solidifies at the solidification front, certain impurities and gas can be rejected from solution and become trapped within the solidifying metal. Gasses, such as hydrogen, can collect to form bubbles that result in voids in the solidified metal, which can be generally known as porosity of the ingot. Additionally, rejection of impurities at the solidifying interface can result in uneven distribution of the impurities throughout the ingot.

Certain aspects of the present disclosure involve stirring the molten sump. Such stirring can be achieved in many ways, such as through the use of contact stirrers, non-contact stirrers, or adjustments to the way the liquid metal enters the sump. Contact stirrers are often undesirable for use with aluminum alloys, at least because of the risk of impurities and oxides. Non-contact stirrers can include electromagnet and permanent-magnet systems designed to induce movement in the molten metal. In some cases, the molten sump can be stirred by adjusting the way the liquid metal enters the sump, such as providing the liquid metal as a powerful jet of liquid metal, such as a jet sufficiently powerful to penetrate to the bottom of the sump. Liquid metal jets can be achieved by increasing the pressure by which the liquid metal is provided, by adjusting the diameter of the nozzle through which the metal is provided, or through other techniques, such as an eductor nozzle used to inject existing molten sump into the jet created by the newly added liquid metal.

Intense stirring in the molten sump can be used to provide stirring along the solidification front. This stirring can wash away forming metal crystals or parts thereof, impurities, gasses, or even some of the liquid metal from the region of the solidification front. The washing away of forming metal crystals (e.g., free moving grains) can help achieve a finer and more uniform grain size, as the forming crystals or broken parts thereof can be re-suspended in the molten sump and act as additional nucleation sites. Further, stirring of sufficient intensity can lower the bulk liquid temperature of the molten sump, thus creating an opportune environment for generation of refined, globular grains. This refined, globular microstructure is stronger than typical microstructures found in DC cast ingots. Ingots cast using certain aspects of the present disclosure, such as intense stirring, can have a higher yield strength and can be less susceptible to cold cracking than ingots cast without intense stirring.

The washing away of impurities from the solidification front can help achieve lower macrosegregation (e.g., a lower degree of macrosegregation), and thus increased homogeneity. This lower macrosegregation achieved through stirring can be beneficial in achieving a desirable protection zone within the ingot. As described in further detail herein, a protection zone can be established by reheating an outer, solidified portion of the ingot being cast. The reheating can prompt the formation of fine dispersoids within the ingot, which can beneficially strengthen the solidified metal, thus minimizing the ingot's susceptibility to cracking. These fine dispersoids can be approximately 30 nm in diameter, although they may be otherwise sized. In some cases, these fine dispersoids can be approximately 10-50 nm, 20-40 nm, or 25-35 nm in diameter.

It has been found that, unexpectedly, intense stirring within the molten sump can reduce or minimize porosity in the cast ingot. The intense stirring can wash rejected hydrogen away from the solidifying interface, re-suspending it in the remainder of the molten sump. The re-suspended hydrogen can agglomerate with other hydrogen, allowing the gas to propagate to the surface of the molten sump, where it remains or becomes discharged from the molten sump. Thus, where rejected hydrogen would have otherwise resulted in undesirable porosity in the cast product, the use of intense stirring has been found to reduce or minimize porosity in the cast product.

Since the presence of impurities and dissolved gases in molten metal can become problematic during casting, traditional casting techniques generally rely on substantial upstream preparation to filter out impurities from the liquid metal and/or to reduce the amount of dissolved gases (e.g., hydrogen) in the liquid metal. Using certain aspects of the present disclosure, this type of upstream preparation to filter out impurities and/or to remove dissolved gases can be significantly reduced or eliminated.

Proper control of the solidification front can be important to achieving a successful cast, especially when using difficult alloys, such as 7xxx series alloys. In traditional DC casting, casting speed can be used to control the solidification front. Increases in casting speed can thicken the solidification front, whereas decreases in casting speed can narrow the solidification front. If the solidification front is too thick, molten metal may not fully percolate through the solidifying regions of the solidification front, which may result in shrinkage porosity and voids. If the solidification front is too thin, hot cracking may occur, where crevices or cracks form between grains due to internal stresses, such as shrinkage-related stresses. Therefore, there is often a tradeoff between susceptibility to shrinkage porosity and susceptibility to hot cracking, which can define or limit the casting speed. In certain alloys especially prone to hot cracking, such as 7xxx series alloys, this tradeoff effectively limits the available casting speed, thus setting an effective maximum to the number of ingots that can be cast in a day.

According to certain aspects of the present disclosure, control of the solidification front can be achieved through a combination of stirring control and casting speed control. Intense stirring can provide numerous benefits that allow hot cracking to be mitigated while allowing high casting speeds. As described above, intense stirring can help narrow the solidification front. Thus, a DC casting process with intense stirring can operate at a higher casting speed than a DC casting process without intense stirring, while maintaining the same thickness of solidification front. Thus, intense stirring can allow for faster casting and therefore more production capability per day. Additionally, stirring can cause the molten sump to extend deeper into the ingot being cast, also referred to herein as the embryonic ingot. In DC casting, the hydrostatic pressure of the molten metal provides the substantial driving force for percolating the liquid metal into the gaps between grains at the solidification front. The deeper molten sump achieved with intense stirring provides a larger hydrostatic pressure head region near the bottom of the sump. This larger hydrostatic pressure head region can facilitate filling gaps between grains at the solidification front, allowing for a thicker solidification front without reduced or no risk of shrinkage porosity or voids. Since a thicker solidification front can be used when intense stirring is employed, the casting speed can be increased even further than would otherwise be available without stirring.

Increased stirring can be controlled to achieve a nominal reduction in thickness of the solidification front (e.g., solidification interface) to a nominal thickness that is on the order of a few millimeters, such between approximately 1 mm and 5 mm or at or less than approximately 10 mm. In some cases, nominal reduction in thickness can be to a nominal thickness that is at or less than approximately 20 mm, 19 mm, 18 mm 17 mm, 16 mm, 15 mm, 14 mm, 13 mm, 12 mm, 11 mm, 10 mm, 9 mm, 8 mm, 7 mm, 6 mm, 5 mm, 4 mm, 3 mm, 2 mm, or 1 mm. As used herein, reference to controlling stirring to achieve a nominal reduction to a particular nominal thickness can refer to controlling stirring to an extent that would result in a reduction to a particular thickness given a constant casting speed. Therefore, while increased stirring accompanied with increased casting speed may achieve little or no effective change in thickness of the solidifying interface, that increased stirring can be described as achieving a particular nominal reduction in thickness of the solidifying interface to a nominal thickness. Additionally, as used herein, a thickness of the solidifying interface can refer to a minimum thickness, a maximum thickness, and average thickness, or a thickness at an applicable point or region within the embryonic ingot. For example, a solidifying interface with a thickness that is at or less than 10 mm can include a solidifying interface in which the maximum thickness at any point of the solidifying interface is at or less than 10 mm; a solidifying interface in which the minimum thickness at any point of the solidifying interface reaches a thickness of at or less than 10 mm; a solidifying interface in which the average thickness throughout the solidifying interface remains at or less than 10 mm; or a solidifying interface in which the average thickness in a region at or near the bottom of the solidifying interface (e.g., a region furthest from the mold), or at any other appropriate point or region, remains at or less than 10 mm.

During DC casting, as the embryonic ingot exits the mold, coolant (e.g., water) is sprayed onto the surface of the ingot to extract heat from the ingot. A wiper or other technique can be used to remove the coolant, thus allowing a portion of the ingot to reheat. This reheating can be used in some cases to homogenize the ingot in-situ (e.g., during casting). In some cases, this in-situ homogenization can occur when the metal reaches rebound temperatures of between approximately 470° C. to approximately 480° C. However, according to certain aspects of the present disclosure, reheating can be controlled to achieve a lower temperature more suitable for precipitation, allowing dispersoids to form in the outer periphery of the ingot. Reheating the embryonic ingot to encourage precipitate formation during casting can be referred to herein as in-situ precipitation.

In some cases, the reheating temperature (e.g., temperature to which the surface of the embryonic ingot is reheated during casting) for achieving desirable in-situ precipitation can be approximately 400° C. to approximately 460° C., approximately 405° C. to approximately 425° C., or approximately 410° C. to approximately 420° C. In some cases, the reheating temperature can be denoted as a percentage of the final homogenization temperature for the alloy, in which case the reheating temperature, such as in Celsius, can be between approximately 80% to approximately 90%, or approximately 85% to approximately 98%, of the final homogenization temperature, such as in Celsius, for the alloy. For example, in the case of a final homogenization temperature of 480° C. the reheating temperature can be approximately 88% of that temperature, or approximately 422° C. As another example, in the case of a final homogenization temperature of 480° C., the reheating temperature can be approximately 96% of that temperature, or approximately 460° C.

Desirable in-situ precipitation can be achieved by reheating the embryonic ingot as identified above and either maintaining a constant temperature or allowing the ingot to cool to or towards room temperature for a period of time. The period of time can be between approximately 3 hours and approximately 5 hours, although in some cases the time can be more or less, such as within a 10% deviation of either endpoint. The in-situ precipitation process can begin during casting of the ingot and can end after the ingot has been cast. An ingot cast using in-situ precipitation can be allowed to cool to or towards room temperature without undergoing quenching immediately after casting. In some cases, when in-situ precipitation is used, a later homogenization step may be performed for a reduced time. For example, a three hour in-situ precipitation at 410° C. can be homogenized for approximately 8 hours at 475° C. and achieve desirable, small precipitates, whereas an ingot cast without in-situ precipitation may require a 10 hour homogenization period at 475° C. and may only be able to achieve undesirable, large-sized precipitates.

Reheating of the embryonic ingot can occur in any suitable fashion, such as application of external heat. However, reheating of the embryonic ingot for in-situ homogenization may generally occur by decreasing the amount of heat extraction occurring at the surface of the embryonic ingot and allowing the latent heat of the ingot, especially that of the molten sump, to reheat the exterior of the ingot. To achieve a desirable in-situ precipitation temperature, the point at which the reheating commences (e.g., the location of the wiper that removes coolant) can be controlled and/or the depth of the molten core can be controlled. For example, by raising the location of the wiper (e.g., moving the wiper closer to the mold), the solid shell can begin to reheat earlier, at a cross section where the molten sump is larger than compared to a cross section further away from the mold, thus allowing the latent heat of even more of the molten sump to reheat the solid shell. In addition to or instead of controlling the point at which reheating commences, the depth of the molten sump itself can be controlled to provide precise control of reheating of the solid shell. For example, by inducing stirring, such as through directing a jet of molten metal into the bottom of the solidifying interface, the metal sump can be extended to a distance further away from the mold than when no extra stirring is induced. As the depth of the molten core extends further away from the mold, the solid shell will be subjected to the latent heat of the molten core for longer periods of time after coolant has been removed.

Additionally, control of where the reheating commences and/or the depth of the molten core can enable control of the surface depth of the dispersoids that are formed during in-situ dispersoid precipitation. As used herein, the term surface depth can refer to the depth into an ingot from the external surface (e.g., rolling faces and sides) towards a center of the ingot (e.g., a longitudinal centerline extending through the center of the ingot in a casting direction). In some cases, control of reheating of the solid shell and/or depth of the molten core can provide for the highest concentrations of dispersoids in a region (e.g., a high-strength zone) that falls approximately ⅓ (33%) of the way towards the longitudinal centerline from a surface of the ingot. In some cases, this region can be at or approximately ½(50%) of the way towards the longitudinal centerline from a surface of the ingot. In some cases, this region can fall between approximately 5%, 10%, 15%, 20%, or 25% and approximately 25%, 30%, 35%, 40%, 45%, or 50% of the way towards the longitudinal centerline from a surface of the ingot. In some cases, this region can extend from a surface of the ingot to the aforementioned depths.

In some cases, the highest concentrations of dispersoids and/or a high-strength zone can be a region of the ingot having a concentration of dispersoids greater than an average concentration of dispersoids of the entire ingot. In some cases, the highest concentrations of dispersoids and/or a high-strength zone can be defined as a region of the ingot having a concentration of dispersoids at least 0.5, 1, 1.5, 2, 2.5, 3, 3.5, or 4 standard deviations over an average concentration of dispersoids of the entire ingot. A high-strength zone (e.g., zone of relatively high concentrations of precipitated dispersoids) can act as protection against cracking as the ingot cools towards room temperature.

Often, there is no relationship between an initial, as-cast microstructure and the final wrought microstructure, due at least in part to the recrystallization of microstructures during hot working and subsequent processing. However, in certain alloys, such as certain 7xxx series alloys, recrystallization can be inhibited through the use of dispersoids, such as by adding elements such as Cr or Zr. By inducing formation of such dispersoids in the as-cast microstructure, the dispersoids can suppress recrystallization or at least substantial changes in average grain size during recrystallization. Since recrystallization is suppressed, the final wrought microstructure can be related to, and more specifically similar to, the initial, as-cast microstructure.

With this ability to relate as-cast microstructure to final, wrought microstructure, techniques to improve as-cast microstructure can become especially beneficial. Addition of grain refining agents can be used to reduce grain size to a certain extent, but the effects of additional grain refiner become limited after a saturation limit has been reached. However, using aspects of the present disclosure, such as intense stirring, further and more desirable grain refinement can be achieved. This finer as-cast microstructure leads to a finer microstructure for the final product, which can have many benefits, such as benefits in corrosion resistance and strength.

In some cases, certain aspects of the present disclosure can be especially suitable for 7xxx series alloys, but may also be beneficial for use with 5xxx or other series alloys. Certain aspects of the present disclosure can help resist "orange peel" defects, such as in 7xxx series. These "orange peel" defects are surface defects that are seen after deformation of the metal article, characterized by surface roughening with an appearance of an outer surface of an orange. These defects are often a result of large grain size. By reducing the final grain size, this defect can become less pronounced after deformation.

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by AA numbers and other related designations, such as "series" or "7xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "room temperature" can include a temperature of from about 15° C. to about 30° C., for example about 15° C., about 16° C., about 17° C., about 18° C., about 19° C., about 20° C., about 21° C. about 22° C., about 23° C., about 24° C., about 25° C., about 26° C., about 27° C., about 28° C., about 29° C., or about 30° C. As used herein, the meaning of "ambient conditions" can include temperatures of about room temperature, relative humidity of from about 20% to about 100%, and barometric pressure of from about 975 millibar (mbar) to about 1050 mbar. For example, relative humidity can be about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, about 50%, about 51%, about 52%, about 53%, about 54%, about 55%, about 56%, about 57%, about 58%, about 59%, about 60%, about 61%, about 62%, about 63%, about 64%, about 65%, about 66%, about 67%, about 68%, about 69%, about 70%, about 71%, about 72%, about 73%, about 74%, about 75%, about 76%, about 77%, about 78%, about 79%, about 80%, about 81%, about 82%, about 83%, about 84%, about 85%, about 86%, about 87%, about 88%, about 89%, about 90%, about 91%, about 92%, about 93%, about 94%, about 95%, about 96%, about 97%, about 98%, about 99%, about 100%, or anywhere in between. For example, barometric pressure can be about 975 mbar, about 980 mbar, about 985 mbar, about 990 mbar, about 995 mbar, about 1000 mbar, about 1005 mbar, about 1010 mbar, about 1015 mbar, about 1020 mbar, about 1025 mbar, about 1030 mbar, about 1035 mbar, about 1040 mbar, about 1045 mbar, about 1050 mbar, or anywhere in between.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10. Unless stated otherwise, the expression "up to" when referring to the compositional amount of an element means that element is optional and includes a zero percent composition of that particular element. Unless stated otherwise, all compositional percentages are in weight percent (wt. %).

As used herein, the meaning of "a," "an," and "the" includes singular and plural references unless the context clearly dictates otherwise.

In the following examples, the aluminum alloy products and their components are described in terms of their elemental composition in weight percent (wt. %). In each alloy, the remainder is aluminum, with a maximum wt. % of 0.15% for the sum of all impurities.

Incidental elements, such as grain refiners and deoxidizers, or other additives may be present in the invention and may add other characteristics on their own without departing from or significantly altering the alloy described herein or the characteristics of the alloy described herein. It is to be understood, however, that the scope of this disclosure should not/cannot be avoided through the mere addition of an incidental element or elements in quantities that would not alter the properties desired in this disclosure.

Unavoidable impurities, including materials or elements, may be present in the alloy in minor amounts due to inherent properties of aluminum or leaching from contact with processing equipment. Some impurities typically found in aluminum include iron and silicon. The alloy, as described, may contain no more than about 0.25 wt. % of any element besides the alloying elements, incidental elements, and unavoidable impurities.

As used herein, the term "slab" indicates an alloy thickness of greater than 15 mm. For example, a slab may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm.

As used herein, a plate generally has a thickness in a range of 5 mm to 50 mm. For example, a plate may refer to an aluminum product having a thickness of about 5 mm, 10 mm, 15 mm, 20 mm, 25 mm, 30 mm, 35 mm, 40 mm, 45 mm, or 50 mm.

As used herein, a shate (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a sheet generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

The cast ingot can be processed by any means known to those of ordinary skill in the art. Optionally, the processing steps can be used to prepare sheets. Such processing steps include, but are not limited to, homogenization, hot rolling, cold rolling, solution heat treatment, and an optional pre-aging step, as known to those of ordinary skill in the art.

In the homogenization step, the cast product described herein is heated to a temperature ranging from about 400° C. to about 500° C. For example, the product can be heated to a temperature of about 400° C., about 410° C., about 420° C., about 430° C., about 440° C., about 450° C., about 460° C., about 470° C., about 480° C., about 490° C., or about 500° C. The product is then allowed to soak (i.e., held at the indicated temperature) for a period of time. In some examples, the total time for the homogenization step, including the heating and soaking phases, can be up to 24 hours. For example, the product can be heated up to 500° C. and soaked, for a total time of up to 18 hours for the homogenization step. Optionally, the product can be heated to below 490° C. and soaked, for a total time of greater than 18 hours for the homogenization step. In some cases, the homogenization step comprises multiple processes. In some non-limiting examples, the homogenization step includes heating the product to a first temperature for a first period of time followed by heating to a second temperature for a second period of time. For example, the product can be heated to about 465° C. for about 3.5 hours and then heated to about 480° C. for about 6 hours.

Following the homogenization step, a hot rolling step can be performed. Prior to the start of hot rolling, the homogenized product can be allowed to cool to a temperature between 300° C. to 450° C. For example, the homogenized product can be allowed to cool to a temperature of between 325° C. to 425° C. or from 350° C. to 400° C. The product can then be hot rolled at a temperature between 300° C. to 450° C. to form a hot rolled plate, a hot rolled shate or a hot rolled sheet having a gauge between 3 mm and 200 mm (e.g., 3 mm, 4 mm, 5 mm, 6 mm, 7 mm, 8 mm, 9 mm, 10 mm, 15 mm, 20 mm, 25 mm, 30 mm, 35 mm, 40 mm, 45 mm, 50 mm, 55 mm, 60 mm, 65 mm, 70 mm, 75 mm, 80 mm, 85 mm, 90 mm, 95 mm, 100 mm, 110 mm, 120 mm, 130 mm, 140 mm, 150 mm, 160 mm, 170 mm, 180 mm, 190 mm, 200 mm, or anywhere in between).

The plate, shate or sheet can then be cold rolled using conventional cold rolling mills and technology into a sheet. The cold rolled sheet can have a gauge between about 0.5 to 10 mm, e.g., between about 0.7 to 6.5 mm. Optionally, the cold rolled sheet can have a gauge of 0.5 mm, 1.0 mm, 1.5 mm, 2.0 mm, 2.5 mm, 3.0 mm, 3.5 mm, 4.0 mm, 4.5 mm, 5.0 mm, 5.5 mm, 6.0 mm, 6.5 mm, 7.0 mm, 7.5 mm, 8.0 mm, 8.5 mm, 9.0 mm, 9.5 mm, or 10.0 mm. The cold rolling can be performed to result in a final gauge thickness that represents a gauge reduction of up to 85% (e.g., up to 10%, up to 20%, up to 30%, up to 40%, up to 50%, up to 60%, up to 70%, up to 80%, or up to 85% reduction). Optionally, an interannealing step can be performed during the cold rolling step. The interannealing step can be performed at a temperature of from about 300° C. to about 450° C. (e.g., about 310° C. about 320° C., about 330° C., about 340° C., about 350° C. about 360° C., about 370° C., about 380° C., about 390° C., about 400° C., about 410° C., about 420° C. about 430° C., about 440° C., or about 450° C.). In some cases, the interannealing step comprises multiple processes. In some non-limiting examples, the interannealing step includes heating the plate, shate or sheet to a first temperature for a first period of time followed by heating to a second temperature for a second period of time. For example, the plate, shate or sheet can be heated to about 410° C. for about 1 hour and then heated to about 330° C. for about 2 hours.

Subsequently, the plate, shate or sheet can undergo a solution heat treatment step. The solution heat treatment step can be any conventional treatment for the sheet which results in solutionizing of the soluble particles. The plate, shate or sheet can be heated to a peak metal temperature (PMT) of up to 590° C. (e.g., from 400° C. to 590° C.) and soaked for a period of time at the temperature. For example, the plate, shate or sheet can be soaked at 480° C. for a soak time of up to 30 minutes (e.g., 0 seconds, 60 seconds, 75 seconds, 90 seconds, 5 minutes, 10 minutes, 20 minutes, 25 minutes, or 30 minutes). After heating and soaking, the plate, shate or sheet is rapidly cooled at rates greater than 100° C./s to a temperature between 500 and 200° C. In one example, the plate, shate or sheet has a quench rate of above 200° C./second at temperatures between 450° C. and 200° C. Optionally, the cooling rates can be faster in other cases.

After quenching, the plate, shate or sheet can optionally undergo a pre-aging treatment by reheating the plate, shate or sheet before coiling. The pre-aging treatment can be performed at a temperature of from about 70° C. to about 125° C. for a period of time of up to 6 hours. For example, the pre-aging treatment can be performed at a temperature of about 70° C., about 75° C. about 80° C., about 85° C., about 90° C., about 95° C., about 100° C., about 105° C., about 110° C., about 115° C., about 120° C., or about 125° C. Optionally, the pre-aging treatment can be performed for about 30 minutes, about 1 hour, about 2 hours, about 3 hours, about 4 hours, about 5 hours, or about 6 hours. The pre-aging treatment can be carried out by passing the plate, shate or sheet through a heating device, such as a device that emits radiant heat, convective heat, induction heat, infrared heat, or the like.

The cast products described herein can also be used to make products in the form of plates or other suitable products. For example, plates including the products as described herein can be prepared by processing an ingot in a homogenization step followed by a hot rolling step. In the hot rolling step, the cast product can be hot rolled to a 200 mm thick gauge or less (e.g., from about 10 mm to about 200 mm). For example, the cast product can be hot rolled to a plate having a final gauge thickness of about 10 mm to about 175 mm, about 15 mm to about 150 mm, about 20 mm to about 125 mm, about 25 mm to about 100 mm, about 30 mm to about 75 mm, or about 35 mm to about 50 mm.

The aluminum alloy products described herein can be used in automotive applications and other transportation applications, including aircraft and railway applications. For example, the disclosed aluminum alloy products can be used to prepare automotive structural parts, such as bumpers, side beams, roof beams, cross beams, pillar reinforcements (e.g., A-pillars, B-pillars, and C-pillars), inner panels, outer panels, side panels, inner hoods, outer hoods, or trunk lid panels. The aluminum alloy products and methods described herein can also be used in aircraft or railway vehicle applications, to prepare, for example, external and internal panels.

The aluminum alloy products and methods described herein can also be used in electronics applications. For example, the aluminum alloy products and methods described herein can be used to prepare housings for electronic devices, including mobile phones and tablet computers. In some examples, the aluminum alloy products can be used to prepare housings for the outer casing of mobile phones (e.g., smart phones), tablet bottom chassis, and other portable electronics.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale. For example, figures depicting metal sumps may include exaggerated features for illustrative purposes.

FIG. 1 is a partial cut-away view of a metal casting system 100 for in-situ dispersoid precipitation according to certain aspects of the present disclosure. A metal source 102, such as a tundish, can supply molten metal down a feed tube 104 and out a nozzle 106. An optional skimmer 108 can be used around the feed tube 104 to help distribute the molten metal and reduce generation of metal oxides at the upper surface of the molten sump 110. A bottom block 120 may be lifted by a hydraulic cylinder 122 to meet the walls of the mold cavity 112. As molten metal begins to solidify within the mold, the bottom block 120 can be steadily lowered at a casting speed. The embryonic ingot 116 can include sides 118 that have solidified, while molten metal added to the cast can be used to continuously lengthen the embryonic ingot 116. The embryonic ingot 116 can include a bottom end 136. In some cases, the walls of the mold cavity 112 define a hollow space and may contain a coolant 114, such as water. The coolant 114 can exit as jets from the hollow space and flow down the sides 118 of the embryonic ingot 116 to help solidify the embryonic ingot 116. The embryonic ingot 116 can include an external solid shell 128, a transitional metal region (e.g., solidifying interface 126), and a molten metal core 124.

To begin promoting dispersoid precipitation, the solidified shell 128 of the embryonic ingot 116 is reheated commencing at a reheater distance 130, defined as the distance from the bottom of the mold cavity 112 (e.g., where the embryonic ingot 116 exits the mold cavity 112) to the location where the solid shell 118 begins reheating. The reheater distance 130 can be the distance between the mold and a location where reheating begins (e.g., location of a reheating device, such as a wiper 142 used to remove coolant 114). The location of where reheating begins can be known as a transition location.

While various techniques can be used to reheat the solid shell 128, FIG. 1 depicts the use of a wiper 142 to remove coolant 114 from the embryonic ingot 116. The wiper 142 of FIG. 1 is depicted as a solid wiper, however other wipers can be used as well, such as fluid-based wipers (e.g., air knives). The coolant 114 is removed from the embryonic ingot 116 at a cross section where the core of the embryonic ingot 116 is still molten. Thus, latent heat from the molten metal core 124, especially from regions of the molten metal core 124 between the reheater distance 130 and the molten metal distance 132 (defined below), can reheat the solid shell 128. Thus, as described in further detail herein, by adjusting the reheater distance 130 and/or the molten metal distance 132, the timing and amount of reheating can be precisely controlled.

The reheater distance 130 can be shorter than a molten metal distance 132 and a sump distance 134. The molten metal distance 132 can be defined as the distance from the bottom of the mold cavity 112 to the bottom of the molten metal core 124. The sump distance 134 can be defined as the distance from the bottom of the mold cavity 112 to the bottom of the solidifying interface 126.

In some cases, the difference between the molten metal distance 132 and the reheater distance 130 can be controlled, such as by inducing changes in the shape of the molten metal core 124 (e.g., by changing casting speed and/or inducing stirring) to adjust the molten metal distance 132, or by moving the wiper 142 to adjust the reheater distance 130. Such casting speed, stirring and/or wiper 142 adjustments can be controlled by a controller 138 coupled to any appropriate actuators. In some cases, controller 138 can perform operations based on a preset routine. In some cases, controller 138 can perform operations based on dynamic feedback from the casting process, such as from temperature measurements taken by a sensor 144. Sensor 144 can be any suitable temperature sensor, such as a contacting or non-contact sensor. Sensor 144 of FIG. 1 is depicted adjacent the solid shell 128 to take a measurement of the surface of the solid shell 128, however that need not be the case. In some cases, sensor(s) can be placed in other locations and can take other ingot measurements, such as sump temperature or coolant temperature.

An optional flow controller 140 can be positioned to control flow of molten metal through the feed tube 104. Examples of suitable flow controllers 140 include retractable pins for slowing and/or halting metal flow, magnetic pumps, electric pumps, or any suitable device for increasing and/or decreasing the flow of metal through the feed tube 104.

While a wiper system is depicted in FIG. 1, other types of reheating techniques can be used at the reheater distance 130 instead of or in addition to a wiper system. For example, direct flame impingement, rotating magnetic heaters, or other devices can be used to apply heat to the solid shell 128 in addition to any latent heat from the molten metal core 124. In some cases, these techniques for applying heat to the solid shell 128 can be controlled, such as controlling an amount of heat provided and/or location where the heat is provided. Such control can be performed by a controller 138.

Figure 2:
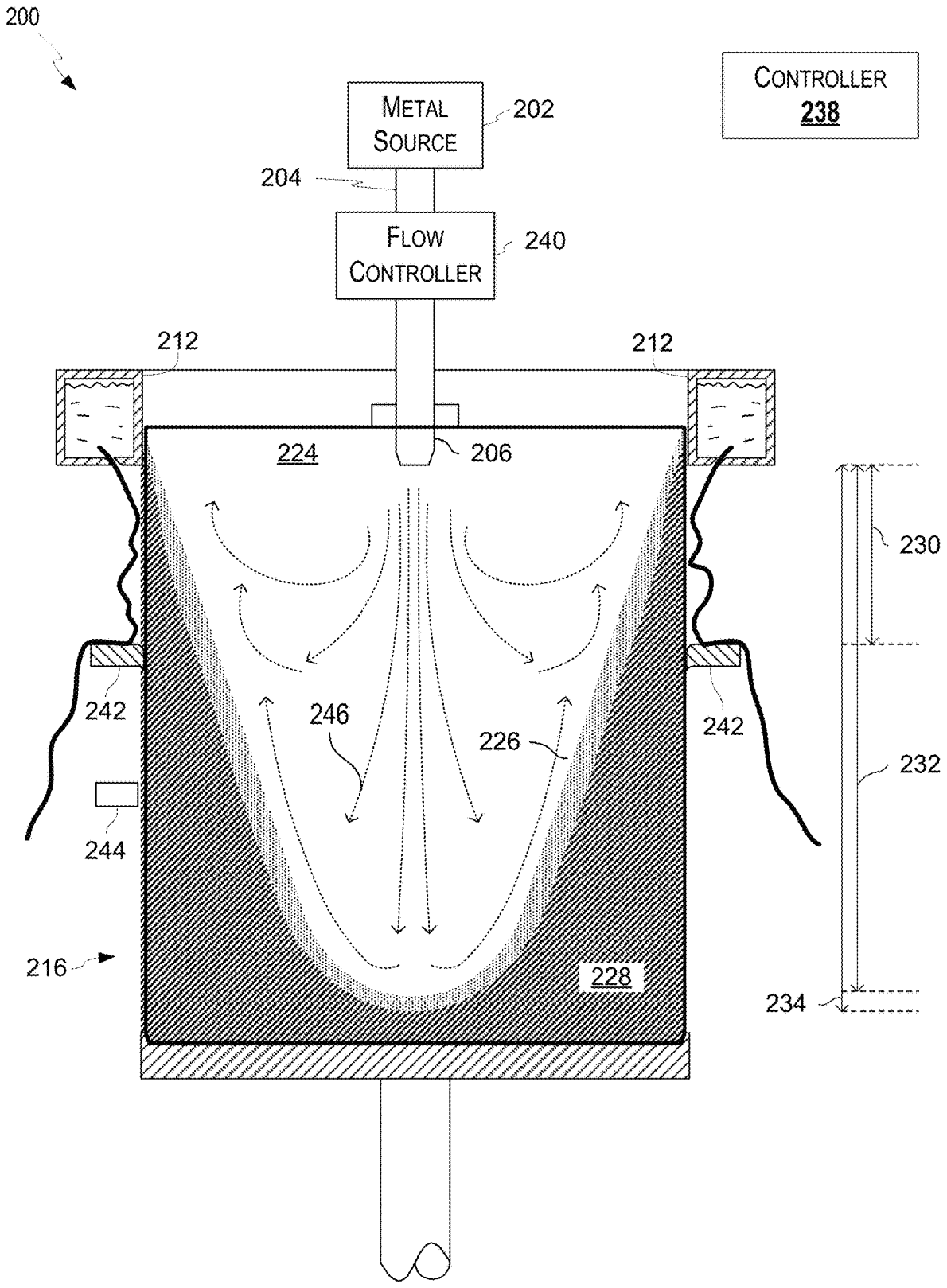
FIG. 2 is a partial cut-away view of a metal casting system for in-situ dispersoid precipitation with sump depth control according to certain aspects of the present disclosure.

FIG. 2 is a partial cut-away view of a metal casting system 200 for in-situ dispersoid precipitation with sump depth control according to certain aspects of the present disclosure. The metal casting system 200 can be similar to the metal casting system 100 of FIG. 1. A metal source 202 can supply molten metal down a feed tube 204, through a flow controller 240, and out a nozzle 206. The flow controller 240 can provide increased flow from the metal source 202 into the molten metal core 224. This increased flow of molten metal through the feed tube 204 can result in increased flow 246 within the molten metal core 224. The increased flow 246 can be or correspond to an increased volumetric flow rate, an increased linear flow rate, or both an increased volumetric flow rate and an increased linear flow rate, such as compared to the flow configuration depicted in FIG. 1.

Such increased flow 246 can provide intense stirring and can act as a jet capable of eroding away a portion of the solidifying interface 226. The jet can create a depression within the solid shell 228 and the solidifying interface 226 at the bottom of the metal sump (e.g., bottom most portion of the liquid metal core 224). By doing so, the molten metal distance 232, as well as the sump distance 234, can be increased.

Thus, with wipers 242 located at the same reheater distance 230 from the mold 212 and wipers 142 in FIG. 1, the solid shell 228 of the embryonic ingot 216 can undergo more heating from the molten metal core 224 than as depicted in FIG. 1, since the difference between the molten metal distance 232 and the reheater distance 230 is greater.

The intensity of stirring and/or amount of flow 246 can be controlled by a controller 238 coupled to any appropriate actuators (e.g., flow controller 240). In some cases, controller 238 can perform operations based on a preset routine. In some cases, controller 238 can perform operations based on dynamic feedback from the casting process, such as from temperature measurements taken by a sensor 244. Sensor 244 can be any suitable temperature sensor, such as a contacting or non-contact sensor. Sensor 244 of FIG. 2 is depicted adjacent the solid shell 228 to take a measurement of the surface of the solid shell 228, however that need not be the case. In some cases, sensor(s) can be placed in other locations and can take other ingot measurements, such as sump temperature or coolant temperature.

Figure 3:
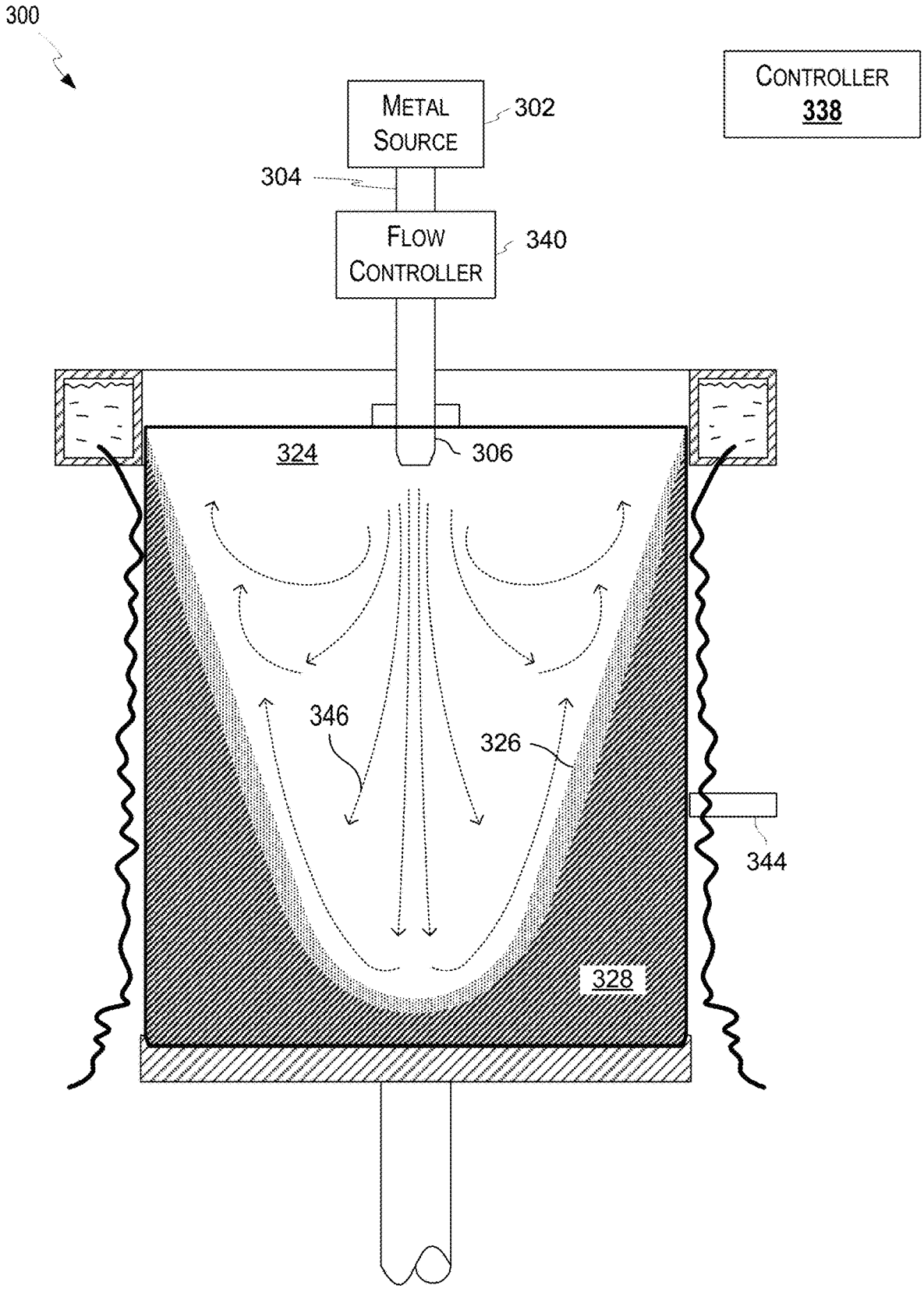
FIG. 3 is a partial cut-away view of a metal casting system for flow-controlled intense stirring according to certain aspects of the present disclosure.

FIG. 3 is a partial cut-away view of a metal casting system 300 for flow-controlled intense stirring according to certain aspects of the present disclosure. Various aspects of the metal casting system 300 can be similar to those aspects of metal casting system 100 of FIG. 1, as appropriate. A metal source 302 can supply molten metal down a feed tube 304, through a flow controller 340, and out a nozzle 306. The flow controller 340 can provide increased flow from the metal source 302 into the molten metal core 324. This increased flow of molten metal through the feed tube 304 can result in increased flow 346 within the molten metal core 324.

Such increased flow 346 can provide intense stirring and can act as a jet capable of eroding away a portion of the solidifying interface 326. The jet can create a depression within the solid shell 328 and solidifying interface 326 at the bottom of the metal sump (e.g., bottom most portion of the liquid metal core 324). The intensity of the flow 346, and thus the resultant jet, can be controlled to achieve a depression of desirable shape. With too-little flow, either no depression or a small-diameter depression may be created. With too-high flow, the depression can have a too-large diameter. However, a desirable depression can have a diameter that matches the diameter of the bottom of the sump, resulting in a sump with a smooth, gradual shape. The shape of the sump with a depression can facilitate flow of molten metal up the sides of the solidifying interface 326, which can facilitate removing rejected impurities and hydrogen from the solidifying interface 326, as well as resuspending grains and improving grain structure to achieve finer grains.

The intensity of stirring and/or amount of flow 346 can be controlled by a controller 338 coupled to any appropriate actuators (e.g., flow controller 340). In some cases, controller 338 can perform operations based on a preset routine. In some cases, controller 338 can perform operations based on dynamic feedback from the casting process, such as from temperature measurements taken by a sensor 344. In some cases, feedback from the sensor 344 can be used to infer a solidifying interface profile (e.g., shape of the solidifying interface) and perform actions to achieve or maintain a desired solidifying interface profile. Sensor 344 can be any suitable temperature sensor, such as a contacting or non-contact sensor. Sensor 344 of FIG. 3 is depicted adjacent the solid shell 328 to take a measurement of the surface of the solid shell 328, however that need not be the case. In some cases, sensor(s) can be placed in other locations and can take other ingot measurements, such as sump temperature or coolant temperature.

Figure 4:
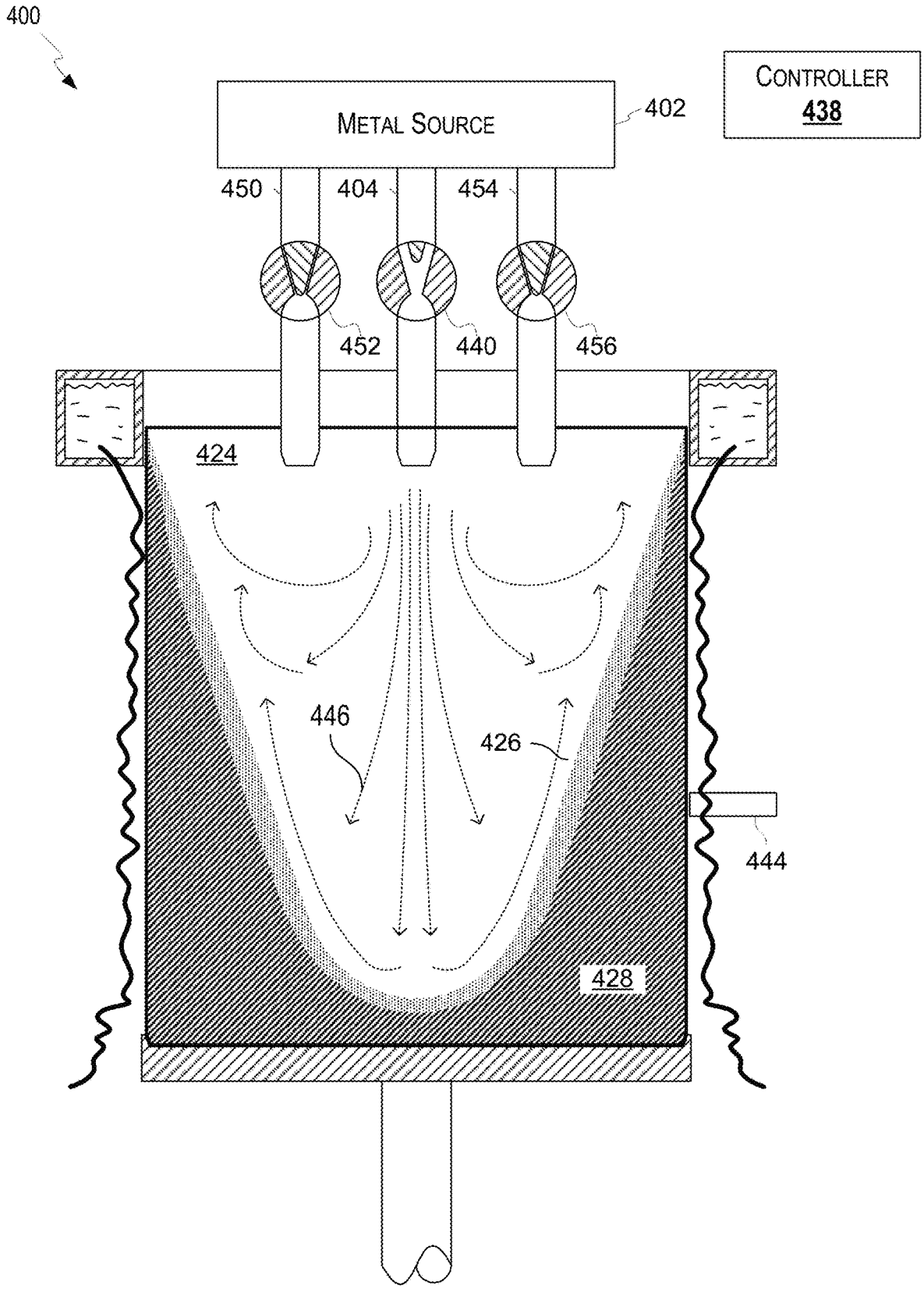
FIG. 4 is a partial cut-away view of a metal casting system for flow-controlled intense stirring with multiple feed tubes according to certain aspects of the present disclosure.

FIG. 4 is a partial cut-away view of a metal casting system 400 for flow-controlled intense stirring with multiple feed tubes according to certain aspects of the present disclosure. Metal casting system 400 can be similar to the metal casting system 300 of FIG. 3. A metal source 402 can supply molten metal down multiple feed tubes 404, 450, 454. As depicted in FIG. 4, three feed tubes are used, although any number of feed tubes can be used. Each feed tube 404, 450, 454 can be associated with a flow controller 440, 456, 452, respectively. Flow controllers 440, 456, 452 are depicted as pin valves, although any suitable flow controller can be used. When multiple feed tubes 404, 450, 454 are used to supply molten metal to the molten metal core 424, increased flow 446 can be achieved by reducing flow through one or more feed tubes (e.g., feed tubes 450, 454) and increasing flow through one or more remaining feed tubes (e.g., feed tube 404). As depicted in FIG. 4, flow controllers 452 and 456 are closed while flow controller 440 is open, allowing more fluid to flow out through the center feed tube 404, thus creating increased flow 446 within the molten metal core 424.

Such increased flow 446 can provide intense stirring and can act as a jet capable of eroding away a portion of the solidifying interface 426. The jet can create a depression within the solid shell 428 and solidifying interface 426 at the bottom of the metal sump (e.g., bottom most portion of the liquid metal core 424). The intensity of the flow 446, and thus the resultant jet, can be controlled (e.g., by actuating any of the flow controllers 452, 440, 456) to achieve a depression of desirable shape. With too-little flow, either no depression or a small-diameter depression may be created. With too-high flow, the depression can have a too-large diameter. However, a desirable depression can have a diameter that matches the diameter of the bottom of the sump, resulting in a sump with a smooth, gradual shape. The shape of the sump with a depression can facilitate flow of molten metal up the sides of the solidifying interface 426, which can facilitate removing rejected impurities and hydrogen from the solidifying interface 426, as well as resuspending grains and improving grain structure to achieve finer grains.

The intensity of stirring and/or amount of flow 446 can be controlled by a controller 438 coupled to any appropriate actuators (e.g., flow controllers 440, 452, 456). In some cases, controller 438 can perform operations based on a preset routine. In some cases, controller 438 can perform operations based on dynamic feedback from the casting process, such as from temperature measurements taken by a sensor 444. In some cases, feedback from the sensor 444 can be used to infer a solidifying interface profile (e.g., shape of the solidifying interface) and perform actions to achieve or maintain a desired solidifying interface profile. Sensor 444 can be any suitable temperature sensor, such as a contacting or non-contact sensor. Sensor 444 of FIG. 4 is depicted adjacent the solid shell 428 to take a measurement of the surface of the solid shell 428, however that need not be the case. In some cases, sensor(s) can be placed in other locations and can take other ingot measurements, such as sump temperature or coolant temperature.

Figure 5:
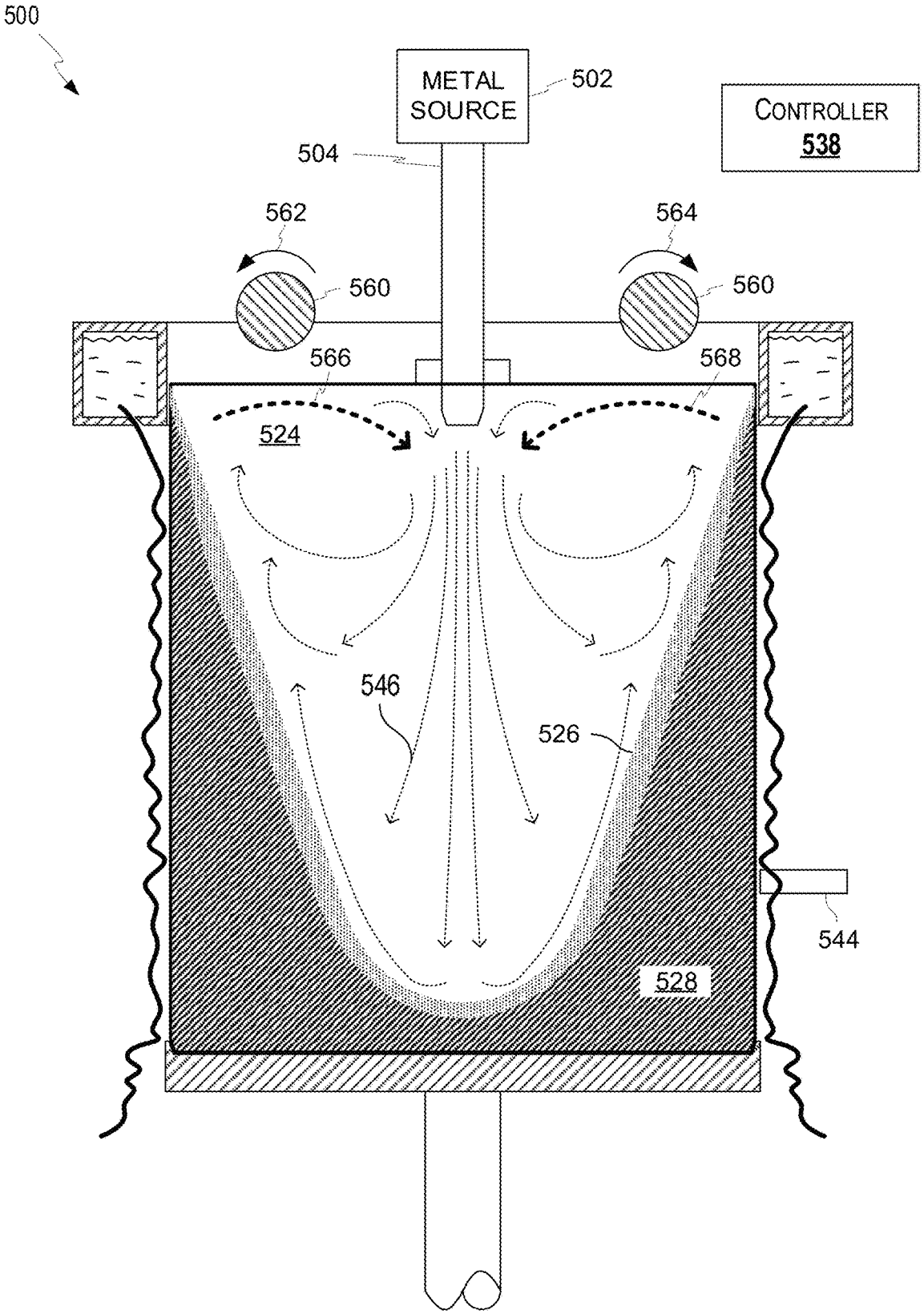
FIG. 5 is a partial cut-away view of a metal casting system for intense stirring with magnetic stirrers according to certain aspects of the present disclosure.

FIG. 5 is a partial cut-away view of a metal casting system 500 for intense stirring with magnetic stirrers according to certain aspects of the present disclosure. Metal casting system 500 can be similar to the metal casting system 300 of FIG. 3. A metal source 502 can supply molten metal down a feed tube 504 and out a nozzle. A flow controller can be used in some cases, although none is depicted in FIG. 5.

Non-contact magnetic stirrers 560 are positioned adjacent the molten metal core 524 to generate surface flow 566, 568. Non-contact magnetic stirrers 560 can be electromagnetic or permanent magnets. In an example, a permanent magnet non-contact magnetic stirrer 560 can be positioned on opposite sides of the feed tube 504 and can rotate in suitable directions 562, 564 for generating surface flow 566, 568 towards the feed tube 504. This surface flow 566, 568 can interact with the molten metal flowing out of the feed tube 504 and provide increased flow 546 within the molten metal core 524.

Such increased flow 546 can provide intense stirring and can act as a jet capable of eroding away a portion of the solidifying interface 526. The jet can create a depression within the solid shell 528 and solidifying interface 526 at the bottom of the metal sump (e.g., bottom most portion of the liquid metal core 524). The intensity of the flow 546, and thus the resultant jet, can be controlled to achieve a depression of desirable shape. With too-little flow, either no depression or a small-diameter depression may be created. With too-high flow, the depression can have a too-large diameter. However, a desirable depression can have a diameter that matches the diameter of the bottom of the sump, resulting in a sump with a smooth, gradual shape. The shape of the sump with a depression can facilitate flow of molten metal up the sides of the solidifying interface 526, which can facilitate removing rejected impurities and hydrogen from the solidifying interface 526, as well as resuspending grains and improving grain structure to achieve finer grains.

The intensity of stirring and/or amount of flow 546 can be controlled by a controller 538 coupled to any appropriate actuators (e.g., non-contact stirrers 560). In some cases, controller 538 can perform operations based on a preset routine. In some cases, controller 538 can perform operations based on dynamic feedback from the casting process, such as from temperature measurements taken by a sensor 544. In some cases, feedback from the sensor 544 can be used to infer a solidifying interface profile (e.g., shape of the solidifying interface) and perform actions to achieve or maintain a desired solidifying interface profile. Sensor 544 can be any suitable temperature sensor, such as a contacting or non-contact sensor. Sensor 544 of FIG. 5 is depicted adjacent the solid shell 528 to take a measurement of the surface of the solid shell 528, however that need not be the case. In some cases, sensor(s) can be placed in other locations and can take other ingot measurements, such as sump temperature or coolant temperature.

Figure 6:
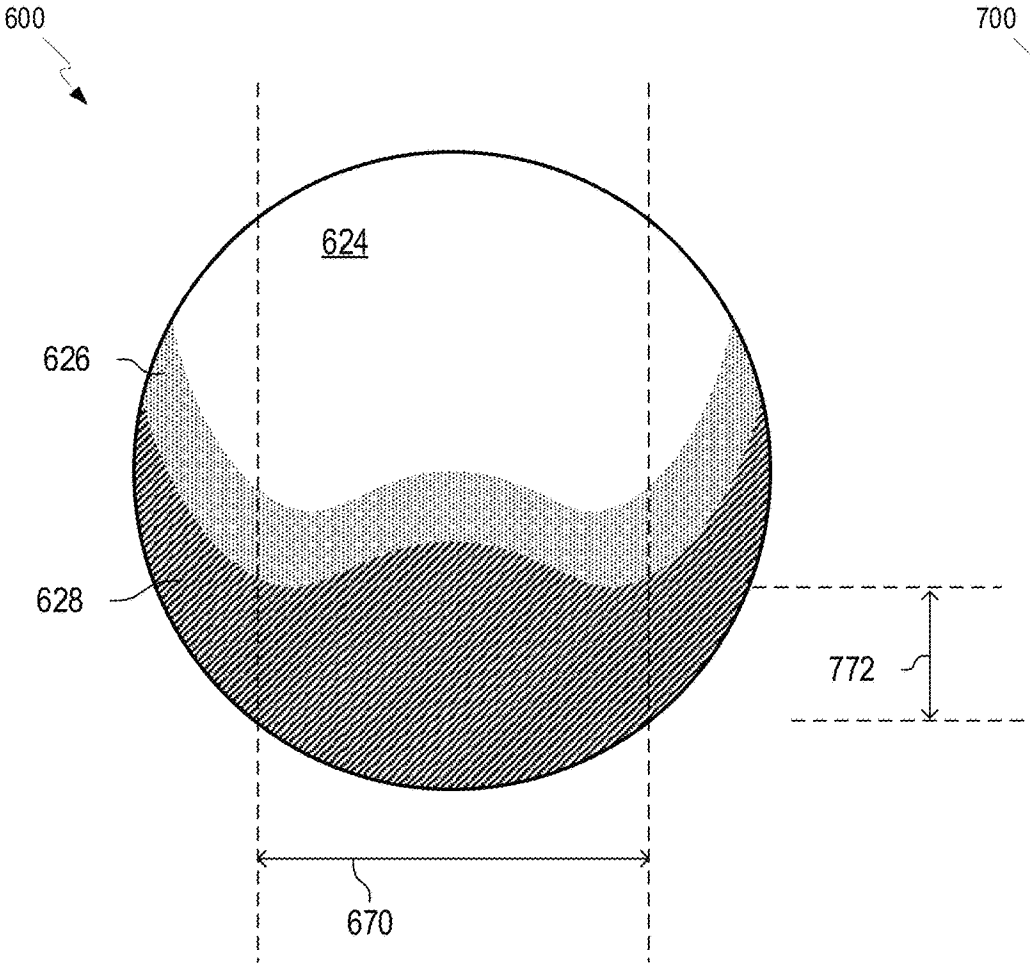
FIG. 6 is a close-up schematic view of a bottom of a molten sump without intense stirring.

FIG. 6 is a close-up schematic view of a bottom of a molten sump 600 without intense stirring. The bottoms of the molten metal core 624 and the solidifying interface 626, as well as the adjacent portion of the solid shell 628, can take on an uneven, built-up shape, which may be due to settling of suspended grains, as well as other factors. As a result, molten metal can remain somewhat stagnant near this region. This bottom region of the molten sump can have a width 670, which may be approximately defined between the regions where the sloping walls of the solidifying interface 626 reach maximum depths.

Figure 7:
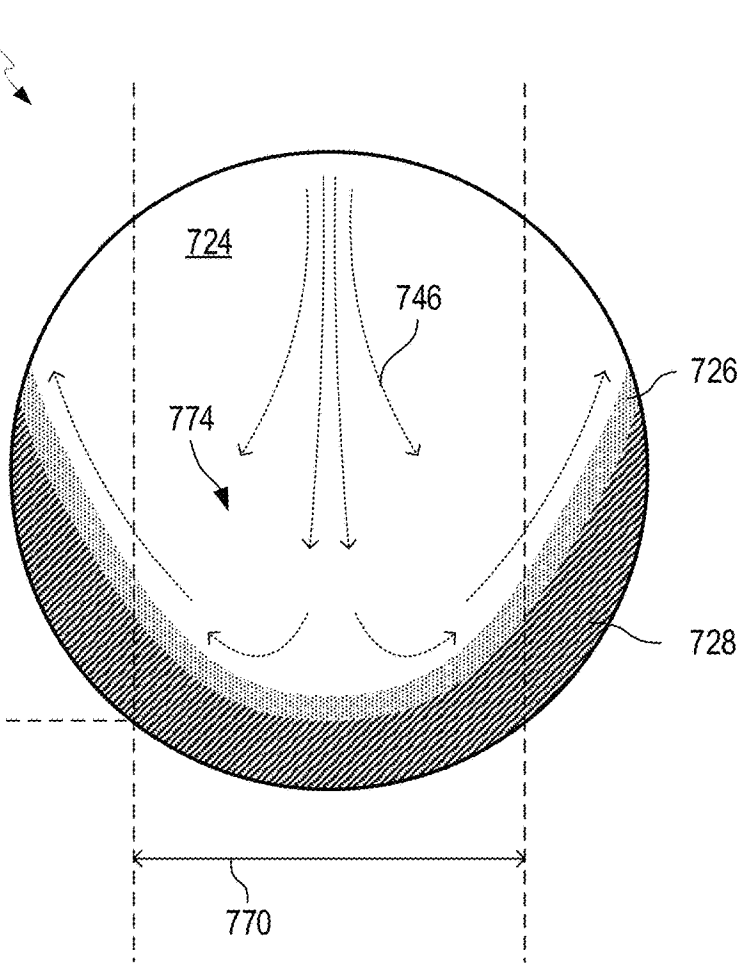
FIG. 7 is a close-up schematic view of a bottom of a molten sump undergoing intense stirring, according to certain aspects of the present disclosure.

FIG. 7 is a close-up schematic view of a bottom of a molten sump 700 undergoing intense stirring, according to certain aspects of the present disclosure. The bottoms of the molten metal core 724 and the solidifying interface 726, as well as the adjacent portion of the solid shell 728, can take on an even, U-shaped or parabolic profile, due to the increased flow 746 of molten metal. The flow 746 of molten metal can erode a depression 774 into the solidifying interface 726 and solid shell 728. This depression 774 can have a depth 772 extending from the bottom of the sump pre-stirring (e.g., as seen in FIG. 6) to a bottom of the depression 774 during stirring (e.g., as seen in FIG. 7). The depression 774 can have a diameter 770 (e.g., a largest diameter) that is approximately equal to the diameter of the sump pre-stirring (e.g., width 670 of FIG. 6).

Figure 8:
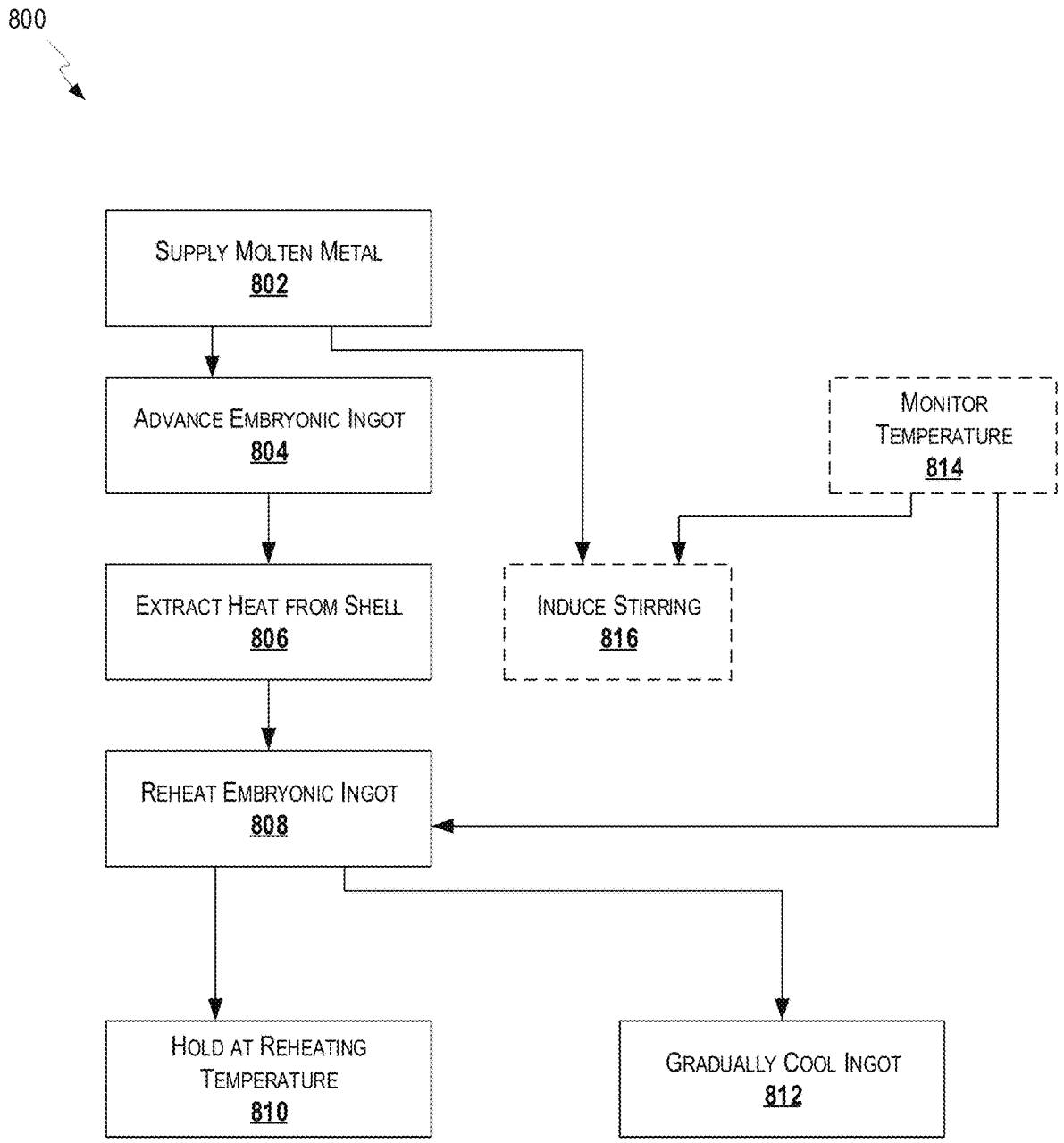
FIG. 8 is a flowchart depicting a process for in-situ dispersoid precipitation, according to certain aspects of the present disclosure.

The flow 746 of the molten metal can be controlled to erode the solidifying interface 726, at least at or adjacent the bottom of the solidifying interface 726, to a thickness that is on the order of a few millimeters, such between approximately 1 mm and 5 mm or at or less than approximately 10 mm. In some cases, the flow 746 can be controlled to erode the solidifying interface 726, at least at or adjacent the bottom of the solidifying interface 726, to a thickness that is at or less than approximately 20 mm, 19 mm, 18 mm 17 mm, 16 mm, 15 mm, 14 mm, 13 mm, 12 mm, 11 mm, 10 mm, 9 mm, 8 mm, 7 mm, 6 mm, 5 mm, 4 mm, 3 mm, 2 mm, or 1 mm. FIG. 8 is a flowchart depicting a process 800 for in-situ dispersoid precipitation, according to certain aspects of the present disclosure. At block 802, molten metal is supplied to a mold. At block 804, an embryonic ingot being formed within the mold is advanced in a casting direction. At block 806, heat is continuously extracted from the shell between the bottom of the mold where the embryonic ingot exits the mold and a reheating location. At block 808, the embryonic ingot is reheated. Reheating can commence at the reheating location. In some cases, reheating can include removing coolant supplied to the surface of the embryonic ingot during block 806. At block 810, the embryonic ingot can be held at the reheating temperature for a period of time, such as approximately 3 hours. In some cases, instead of holding the ingot at the reheating temperature, the ingot is permitted to gradually cool at block 812. The ingot can gradually cool to a room temperature, such as over the course of a period of time of at least approximately 3 hours.

In some cases, stirring can be optionally induced at block 816. Stirring can be induced to improve various characteristics of the as-cast ingot, as well as to lower the depth of the molten sump, thus affecting the reheating performed at block 808.

In some cases, temperature monitoring can be optionally performed at block 814. The results of the temperature monitoring can be used to adjust an amount of stirring induced at block 816 and/or a reheating position used with respect to block 808. Temperature monitoring at block 814 can occur continuously.

Figure 9:
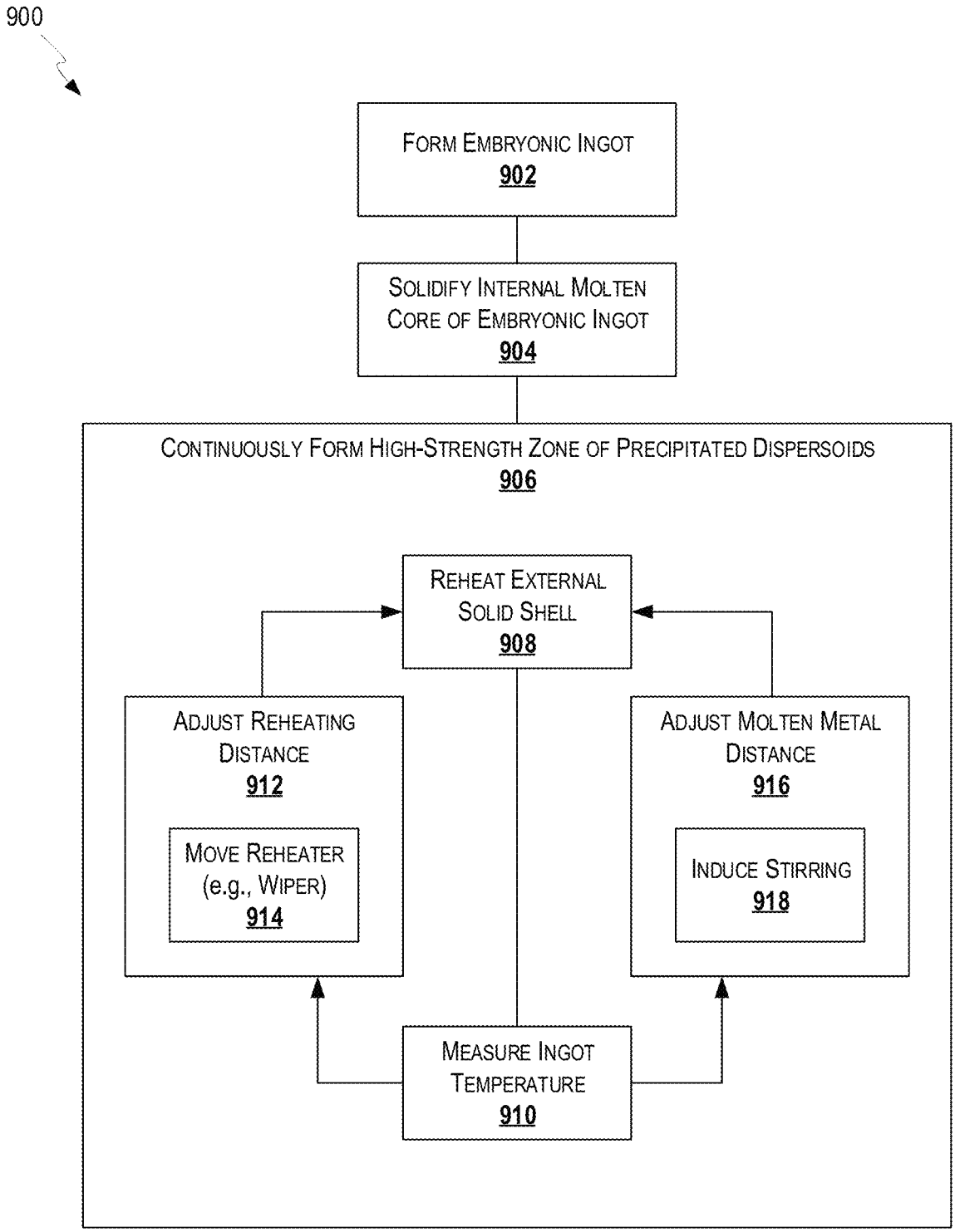
FIG. 9 is a flowchart depicting a process for generating a high-strength zone of precipitated dispersoids in a direct chill cast ingot, according to certain aspects of the present disclosure.

FIG. 9 is a flowchart depicting a process 900 for generating a high-strength zone of precipitated dispersoids in a direct chill cast ingot, according to certain aspects of the present disclosure. At block 902, an embryonic ingot can be formed or can start to form. At block 904, at least some of the internal molten core of the embryonic ingot can be solidified, forming the solid shell of the embryonic ingot. At block 906, a high-strength zone of precipitated dispersoids can be continuously formed.

Continuously forming the high-strength zone of precipitated dispersoids at block 906 can include reheating the external solid shell at block 908 at a reheater distance. In some cases, a temperature of the ingot can be measured at block 910. This measurement can be used to adjust the reheater distance at block 912 and/or to adjust a molten metal distance at block 916. Adjusting the reheater distance at block 912 can include moving the reheater (e.g., a wiper) at block 914. Adjusting the molten metal distance at block 916 can include inducing stirring at block 918.

Figure 10:
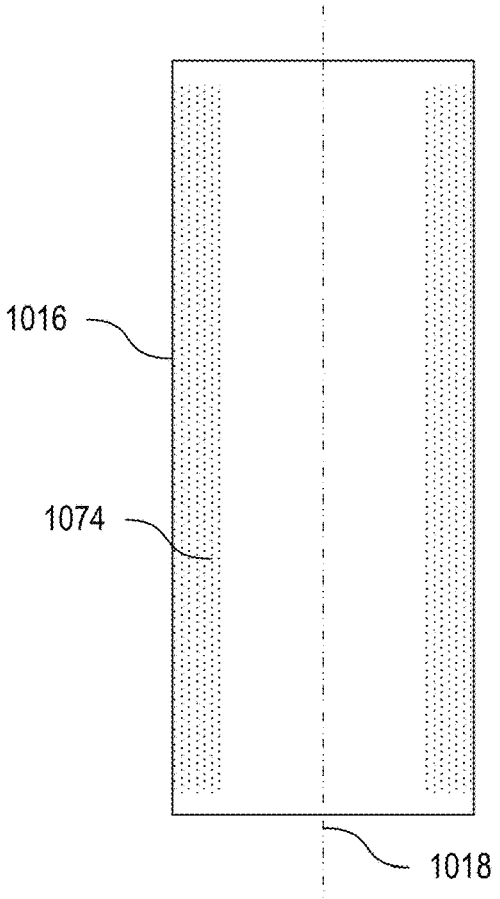
FIG. 10 is a schematic cross-sectional elevation view of an ingot depicting a high-strength zone according to certain aspects of the present disclosure.

FIG. 10 is a schematic cross-sectional elevation view of an ingot 1016 depicting a high-strength zone 1074 according to certain aspects of the present disclosure. The high-strength zone 1074 is depicted extending from at or near the surface of the ingot 1016 to a surface depth that is less than halfway from the surface of the ingot 1016 to a longitudinal centerline 1018 of the ingot 1016.

Figure 11:
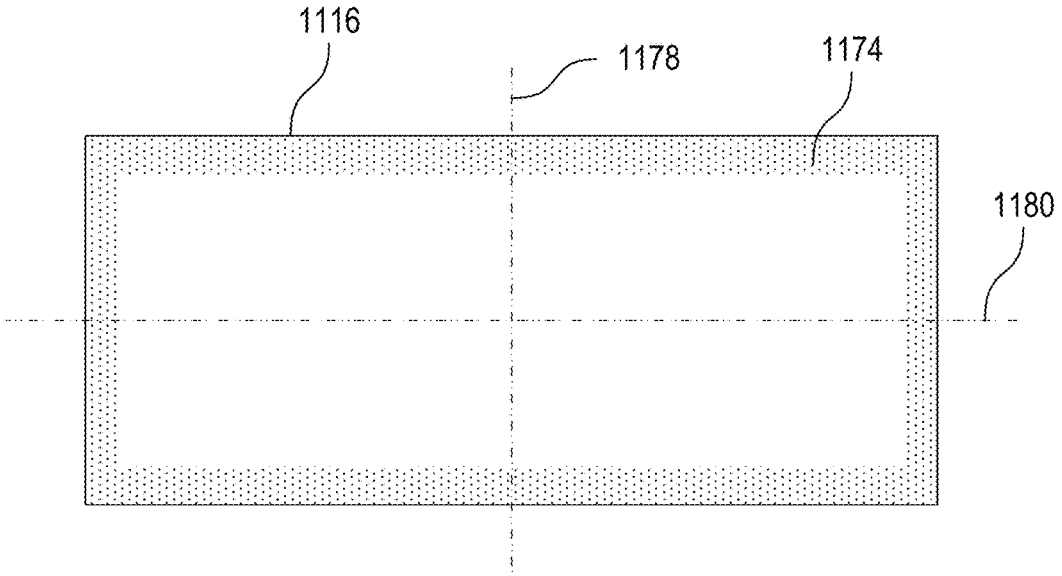
FIG. 11 is a schematic cross-sectional top view of an ingot depicting a high-strength zone according to certain aspects of the present disclosure.

FIG. 11 is a schematic cross-sectional top view of an ingot 1116 depicting a high-strength zone 1174 according to certain aspects of the present disclosure. The high-strength zone 1174 is depicted extending from at or near a surface (e.g., rolling surface and/or side surface) of the ingot 1116 to a surface depth less than halfway from the surface of the ingot 1116 to associated centerlines, such as from a rolling surface of the ingot 1116 to a lateral centerline 1180 and from a side surface of the ingot 1116 to a rolling face centerline 1178.

Figure 12:
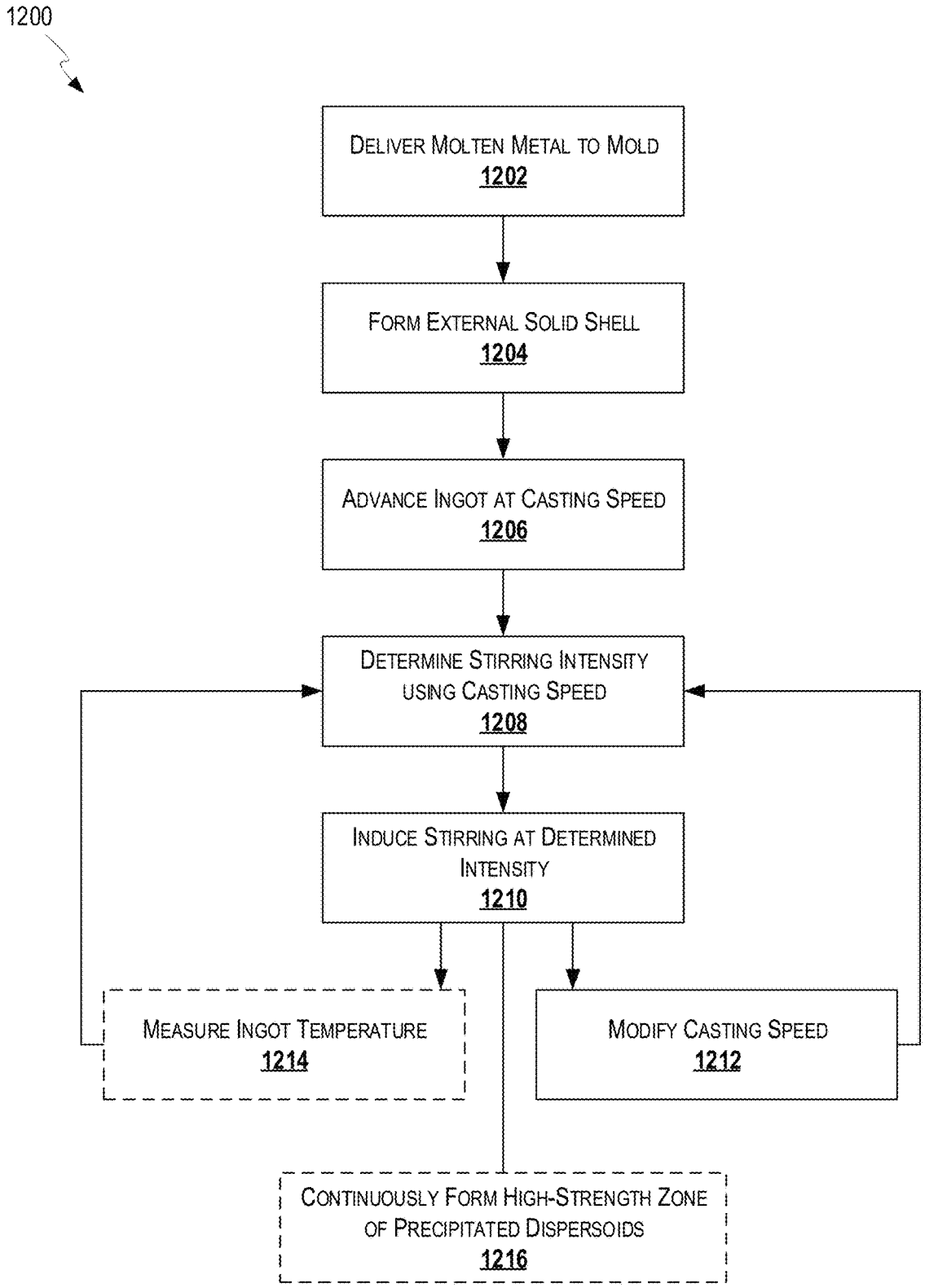
FIG. 12 is a flowchart depicting a process for producing an intensely-stirred direct chill cast ingot according to certain aspects of the present disclosure.

FIG. 12 is a flowchart depicting a process 1200 for producing an intensely-stirred direct chill cast ingot according to certain aspects of the present disclosure. At block 1202, molten metal can be delivered to a mold. At block 1204, an external solid shell can be formed as heat is extracted from the molten metal. At block 1206, the ingot can be advanced out of the mold at a casting speed. At block 1208, a stirring intensity can be determined using the casting speed. The stirring intensity can be based on a sensed or otherwise known casting speed. At block 1210, stirring can be induced at the intensity determined at block 1208. Inducing stirring can include using a flow controller and/or non-contact stirrers, although other techniques can be used. At block 1212, the casting speed can be modified. Upon modifying the casting speed, the stirring intensity can be determined again at block 1208 based on the updated casting speed from block 1212. Thereafter, the stirring can be induced at the newly-determined intensity. At optional block 1214, a temperature of the embryonic ingot can be monitored. Upon monitoring the ingot temperature, the stirring intensity can be determined again at block 1208 based at least in part also on the temperature measured at block 1214. Thereafter, the stirring can be induced at the newly-determined intensity.

At optional block 1216, a high-strength zone of precipitate dispersoids can be continuously formed as disclosed herein.

ILLUSTRATIVE ASPECTS

As used below, any reference to a series of aspects is to be understood as a reference to each of those examples disjunctively (e.g., "Aspects 1-4" is to be understood as "Aspects 1, 2, 3, or 4").

Aspect 1 is a method, such as a casting method, the method comprising: supplying molten metal to a casting mold and forming an embryonic ingot comprising an external solid shell and an internal molten core; advancing the embryonic ingot in a direction of advancement away from the casting mold while supplying additional molten metal to the casting mold, extracting heat from the embryonic ingot between the casting mold and a transition location by directing a supply of liquid coolant to an outer surface of the external solid shell; and reheating the embryonic ingot at the transition location such that at least a portion of the external solid shell of the embryonic ingot at the transition location reaches a temperature suitable for precipitating dispersoids and lower than a homogenizing temperature of the molten metal, wherein the transition location lies in a plane that is perpendicular to the direction of advancement and that intersects the internal molten core.

Aspect 2 is the method of any previous or subsequent aspect, wherein the temperature, such as in Celsius, is between 80% and 90% of the homogenizing temperature, such as in Celsius, of the molten metal.

Aspect 3 is the method of any previous or subsequent aspect, wherein the temperature, such as in Celsius, is between 85% and 90% of the homogenizing temperature, such as in Celsius, of the molten metal.

Aspect 4 is the method of any previous or subsequent aspect, wherein the temperature is between 400° C. and 460° C.

Aspect 5 is the method of any previous or subsequent aspect, wherein the temperature is between 410° C. and 420° C.

Aspect 6 is the method of any previous or subsequent aspect, further comprising maintaining the temperature at the portion of the external solid shell for at least 3 hours.

Aspect 7 is the method of any previous or subsequent aspect, wherein reheating the embryonic ingot comprises removing the liquid coolant from the outer surface of the external solid shell.

Aspect 8 is the method of any previous or subsequent aspect, wherein reheating the embryonic ingot further comprises applying heat to the outer surface of the external solid shell to supplement latent heating from the internal molten core.

Aspect 9 is the method of any previous or subsequent aspect, further comprising: taking temperature measurements of the embryonic ingot; and dynamically adjusting the transition location based on the temperature measurements.

Aspect 10 is the method of any previous or subsequent aspect, further comprising: inducing stirring in the internal molten core adjacent an interface between the internal molten core and the external solid shell.

Aspect 11 is the method of any previous or subsequent aspect, further comprising taking temperature measurements of the embryonic ingot, wherein inducing stirring in the internal molten core comprises dynamically adjusting an intensity of stirring based on the temperature measurements.

Aspect 12 is the method of any previous or subsequent aspect, wherein the transition location is selected such that the plane intersects the embryonic ingot at a cross section where the external solid shell of the embryonic ingot occupies approximately one third of a line extending from the outer surface to a center of the embryonic ingot within the plane.

Aspect 13 is the method of any previous or subsequent aspect, wherein the transition location is selected such that the plane intersects the embryonic ingot at a cross section where the external solid shell of the embryonic ingot occupies no more than 50% of a line extending from the outer surface to a center of the embryonic ingot within the plane.

Aspect 14 is the method of any previous or subsequent aspect, wherein the molten metal is a 7xxx series aluminum alloy.

Aspect 15 is a method, comprising: forming an embryonic ingot by supplying molten metal to a mold and extracting heat from the molten metal to form an external solid shell; solidifying an internal molten core of the embryonic ingot as the embryonic ingot is advanced in a direction of advancement away from the mold and additional molten metal is supplied to the mold, wherein solidifying the internal molten core comprises extracting heat from the internal molten core through the external solid shell; and continuously forming a high-strength zone within the external solid shell at a cross section of the embryonic ingot that is perpendicular to the direction of advancement and that intersects the internal molten core, wherein the high-strength zone is located between an outer surface of the external solid shell and the internal molten core, and wherein forming the high-strength zone includes reheating the external solid shell at the cross section to induce dispersoid precipitation in the external solid shell.

Aspect 16 is the method of any previous or subsequent aspect, wherein reheating the external solid shell at the cross section comprises reheating a portion of the external solid shell to a temperature suitable for precipitating dispersoids, wherein the temperature is lower than a homogenizing temperature of the molten metal.

Aspect 17 is the method of any previous or subsequent aspect, wherein the temperature, such as in Celsius, is between 80% and 98% of the homogenizing temperature, such as in Celsius, of the molten metal.

Aspect 18 is the method of any previous or subsequent aspect, wherein the temperature is between 85% and 90% of the homogenizing temperature of the molten metal.

Aspect 19 is the method of any previous or subsequent aspect, wherein the temperature is between 400° C. and 460° C.

Aspect 20 is the method of any previous or subsequent aspect, wherein the temperature is between 410° C. and 420° C.

Aspect 21 is the method of any previous or subsequent aspect, further comprising maintaining the temperature at the portion of the external solid shell for at least 3 hours, such as from 3 hours to 10 hours.

Aspect 22 is the method of any previous or subsequent aspect, wherein extracting heat from the internal molten core through the external solid shell comprises supplying liquid coolant to the outer surface of the external shell, and wherein reheating the external solid shell comprises removing the liquid coolant from the outer surface of the external solid shell.

Aspect 23 is the method of any previous or subsequent aspect, wherein reheating the external solid shell further comprises applying heat to the outer surface of the external solid shell to supplement latent heating from the internal molten core.

Aspect 24 is the method of any previous or subsequent aspect, further comprising: taking temperature measurements of the embryonic ingot; and dynamically adjusting a distance between the mold and the cross section based on the temperature measurements.

Aspect 25 is the method of any previous or subsequent aspect, further comprising: inducing stirring in the internal molten core adjacent an interface between the internal molten core and the external solid shell.

Aspect 26 is the method of any previous or subsequent aspect, further comprising taking temperature measurements of the embryonic ingot, wherein inducing stirring in the internal molten core comprises dynamically adjusting an intensity of stirring based on the temperature measurements.

Aspect 27 is the method of any previous or subsequent aspect, wherein, at the cross section, the external solid shell of the embryonic ingot occupies approximately one third of a line extending from the outer surface to a center of the embryonic ingot.

Aspect 28 is the method of any previous or subsequent aspect, wherein, at the cross section, the external solid shell of the embryonic ingot occupies no more than 50% of a line extending from the outer surface to a center of the embryonic ingot.

Aspect 29 is the method of any previous or subsequent aspect, wherein the molten metal is a 7xxx series aluminum alloy.

Aspect 30 is the method of any previous or subsequent aspect, wherein the high-strength zone includes a higher concentration of dispersoids than a remainder of the external solid shell.

Aspect 31 is an aluminum metal product, comprising: a mass of solidified aluminum alloy having two ends and an outer surface, wherein the mass of solidified aluminum alloy comprises: a core region containing a center of the mass of solidified aluminum alloy; an outer region incorporating the outer surface; and a high-strength zone disposed between the core region and the outer region, wherein the high-strength zone has a higher concentration of dispersoids than each of the core region and the outer region.

Aspect 32 is the aluminum metal product of any previous or subsequent aspect, wherein the mass of solidified aluminum alloy comprises retained heat from a direct chill casting process.

Aspect 33 is the aluminum metal product of any previous or subsequent aspect, wherein the high-strength zone is located at a depth of approximately one third of a line extending from the outer surface to the center of the mass of solidified aluminum alloy along a cross section of the mass of solidified aluminum alloy.

Aspect 34 is the aluminum metal product of any previous or subsequent aspect, wherein the high-strength zone is located at a depth of no more than one half of a line extending from the outer surface to the center of the mass of solidified aluminum alloy along a cross section of the mass of solidified aluminum alloy.

Aspect 35 is the aluminum metal product of any previous or subsequent aspect, wherein the mass of solidified aluminum alloy is cylindrical in shape.

Aspect 36 is the aluminum metal product of any previous or subsequent aspect, wherein a cross section of the mass of solidified aluminum alloy that is perpendicular to a direction of casting of the mass of solidified aluminum alloy is rectangular in shape.

Aspect 37 is the aluminum metal product of any previous or subsequent aspect, wherein the mass of solidified aluminum alloy is a mass of solidified series 7xxx aluminum alloy.

Aspect 38 is the aluminum metal product of any previous or subsequent aspect made according to the method of any previous or subsequent aspect.

Aspect 39 is an embryonic ingot, comprising: a liquid molten core of aluminum alloy extending from an upper surface to a solidifying interface; and a solidified shell of the aluminum alloy, the solidified shell comprising an outer surface extending from the solidifying interface to a bottom end in a casting direction, wherein the solidified shell comprises a high-strength zone disposed between the outer surface and a centerline extending in the casting direction through a center of the liquid molten core and a center of the solidified shell, wherein the high-strength zone has a higher concentration of dispersoids than a remainder of the solidified shell.

Aspect 40 is the embryonic ingot of any previous or subsequent aspect, wherein the high-strength zone is located at a depth of approximately one third of a line extending from the outer surface to the centerline.

Aspect 41 is the embryonic ingot of any previous or subsequent aspect, wherein the high-strength zone is located at a depth of no more than one half of a line extending from the outer surface to the centerline.

Aspect 42 is the embryonic ingot of any previous or subsequent aspect, wherein the solidified shell is cylindrical in shape.

Aspect 43 is the embryonic ingot of any previous or subsequent aspect, wherein a cross section of the solidified sell that is perpendicular to the casting direction is rectangular in shape.

Aspect 44 is the embryonic ingot of any previous or subsequent aspect, wherein the aluminum alloy is a series 7xxx aluminum alloy.

Aspect 45 is the embryonic ingot of any previous or subsequent aspect made according to the method of any previous or subsequent aspect.

Aspect 46 is a method, comprising: delivering molten metal from a metal source to a metal sump of an embryonic ingot being cast in a mold; forming an external solid shell of solidified metal by extracting heat from the metal sump, wherein a solidifying interface is located between the external solid shell and the metal sump; advancing the embryonic ingot in a direction of advancement away from the mold at a casting speed while delivering the molten metal and forming the external solid shell; determining an intensity of stirring using the casting speed, wherein the intensity of stirring is suitable to achieve a target solidification interface profile at the casting speed; and inducing stirring within the molten sump at the determined intensity, wherein inducing stirring within the molten sump induces the solidification interface to take on the target solidification interface profile at the casting speed.

Aspect 47 is the method of any previous or subsequent aspect, wherein inducing stirring comprises applying stirring forces to the molten metal in the metal sump using anon-contact magnetic stirrer.

Aspect 48 is the method of any previous or subsequent aspect, wherein delivering molten metal comprises delivering molten metal at a mass flow rate through a plurality of nozzles, and wherein inducing stirring comprises increasing a flow rate of molten metal through at least one of the plurality of nozzles while maintaining the mass flow rate through the plurality of nozzles.

Aspect 49 is the method of any previous or subsequent aspect, further comprising: modifying the casting speed; determining an updated intensity of stirring using the updated casting speed, wherein the updated intensity of stirring is suitable to achieve the target solidification profile at the updated casting speed; and inducing stirring within the molten sump at the updated intensity, wherein inducing stirring within the molten sump at the updated intensity induces the solidification interface to take on the target solidification interface profile at the updated casting speed.

Aspect 50 is the method of any previous or subsequent aspect, wherein the molten metal is a 7xxx series aluminum alloy.

Aspect 51 is the method of any previous or subsequent aspect, further comprising measuring a temperature of the embryonic ingot, wherein determining the intensity of stirring using the casting speed comprises using the measured temperature.

Aspect 52 is the method of any previous or subsequent aspect, wherein the target solidification interface profile is predetermined to minimize a risk of cracking.

Aspect 53 is the method of any previous or subsequent aspect, further comprising: continuously forming a high-strength zone within the external solid shell at a cross section of the embryonic ingot that is perpendicular to the direction of advancement and that intersects the internal molten core, wherein the high-strength zone is located between an outer surface of the external solid shell and the internal molten core, and wherein forming the high-strength zone includes reheating the external solid shell at the cross section to induce dispersoid precipitation in the external solid shell.

Aspect 54 is the method of any previous or subsequent aspect, wherein inducing stirring within the molten sump comprises controlling delivery of the molten metal into the metal sump such that a jet of molten metal erodes a depression into the solidifying interface at a bottom of the metal sump, the depression having a diameter sized to match a diameter of the bottom of the metal sump.

Aspect 55 is a method, comprising: delivering molten metal from a metal source to a metal sump of an embryonic ingot being cast in a mold; forming an external solid shell of solidified metal by extracting heat from the metal sump, wherein a solidifying interface is located between the external solid shell and the metal sump; advancing the embryonic ingot in a direction of advancement away from the mold at a casting speed while delivering the molten metal and forming the external solid shell; and controlling delivery of the molten metal into the metal sump to generate a jet of molten metal sufficient to erode at least a portion of the solidifying interface at a bottom of the metal sump.

Aspect 56 is the method of any previous or subsequent aspect, wherein controlling delivery of the molten metal comprises controlling delivery of the molten metal such that the jet of molten metal erodes the solidifying interface to a thickness that is at or less than 10 mm.

Aspect 57 is the method of any previous or subsequent aspect, wherein delivering the molten metal comprises delivering the molten metal at a mass flow rate through a plurality of nozzles, and wherein generating the jet of molten metal comprises increasing a flow rate of molten metal through at least one of the plurality of nozzles while maintaining the mass flow rate through the plurality of nozzles.

Aspect 58 is the method of any previous or subsequent aspect, further comprising applying stirring forces to the molten metal in the metal sump using a non-contact magnetic stirrer.

Aspect 59 is the method of any previous or subsequent aspect, further comprising modifying the casting speed, wherein controlling delivery of the molten metal includes dynamically adjusting delivery of the molten metal based on the modified casting speed such that the jet of molten metal continues to erode at least the portion of the solidifying interface at the bottom of the metal sump.

Aspect 60 is the method of any previous or subsequent aspect, wherein the molten metal is a 7xxx series aluminum alloy.

Aspect 61 is the method of any previous or subsequent aspect, further comprising measuring a temperature of the embryonic ingot, wherein controlling delivery of the molten metal comprises dynamically adjusting delivery of the molten metal based on the measured temperature such that the jet of molten metal continues to erode at least the portion of the solidifying interface at the bottom of the metal sump.

Aspect 62 is the method of any previous or subsequent aspect, further comprising: continuously forming a high-strength zone within the external solid shell at a cross section of the embryonic ingot that is perpendicular to the direction of advancement and that intersects the metal sump, wherein the high-strength zone is located between an outer surface of the external solid shell and the metal sump, and wherein forming the high-strength zone comprises reheating the external solid shell at the cross section to induce dispersoid precipitation in the external solid shell.

Aspect 63 is an aluminum metal product made according to the methods of any previous or subsequent aspect.

Aspect 64 is an embryonic ingot, comprising: a solidified shell of aluminum alloy extending from a solidifying interface to a bottom end in a casting direction; and a liquid molten core of the aluminum alloy extending from an upper surface to the solidifying interface, wherein the liquid molten core includes a jet of the aluminum alloy impinging the solidifying interface at a bottom of the liquid molten core to form a depression in the solidifying interface.

Aspect 65 is the embryonic ingot of any previous or subsequent aspect, wherein the liquid molten core includes re-suspended grains from the solidifying interface.

Aspect 66 is the embryonic ingot of any previous or subsequent aspect, wherein the liquid molten core includes re-suspended hydrogen from the solidifying interface.

Aspect 67 is the embryonic ingot of any previous or subsequent aspect, wherein the solidified shell comprises a high-strength zone disposed between an outer surface of the solidified shell and a centerline extending in the casting direction through a center of the liquid molten core and a center of the solidified shell, wherein the high-strength zone has a higher concentration of dispersoids than a remainder of the solidified shell.

Aspect 68 is the embryonic ingot of any previous or subsequent aspect, wherein the aluminum alloy is a series 7xxx aluminum alloy.

All patents and publications cited herein are incorporated by reference in their entirety. The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A casting method, comprising:

supplying molten metal to a casting mold and forming an embryonic ingot comprising an external solid shell and an internal molten core, wherein the molten metal is a 7xxx series aluminum alloy;

advancing the embryonic ingot in a direction of advancement away from the casting mold while supplying additional molten metal to the casting mold;

extracting heat from the embryonic ingot between the casting mold and a transition location by directing a supply of liquid coolant to an outer surface of the external solid shell; and reheating the embryonic ingot at the transition location to induce dispersoid precipitation, wherein at least a portion of the external solid shell of the embryonic ingot at the transition location reaches a temperature suitable for precipitating dispersoids and lower than a homogenizing temperature of the molten metal, wherein the transition location lies in a plane that is perpendicular to the direction of advancement and that intersects the internal molten core, wherein the temperature is between 400° C. and 420° C., and wherein the method further comprises maintaining the temperature at the portion of the external solid shell for at least 3 hours.

2. The method of claim 1, wherein the temperature, in Celsius, is between 80% and 98% of the homogenizing temperature, in Celsius, of the molten metal.

3. The method of claim 1, wherein the temperature, in Celsius, is between 85% and 90% of the homogenizing temperature, in Celsius, of the molten metal.

4. The method of claim 1, further comprising maintaining the temperature at the portion of the external solid shell for 3 hours to 10 hours.

5. The method of claim 1, wherein reheating the embryonic ingot comprises removing the liquid coolant from the outer surface of the external solid shell.

6. The method of claim 5, wherein reheating the embryonic ingot further comprises applying heat to the outer surface of the external solid shell to supplement latent heating from the internal molten core.

7. The method of claim 1, further comprising:

taking temperature measurements of the embryonic ingot; and dynamically adjusting the transition location based on the temperature measurements.

8. The method of claim 1, further comprising:

inducing stirring in the internal molten core adjacent an interface between the internal molten core and the external solid shell.

9. The method of claim 8, further comprising taking temperature measurements of the embryonic ingot, wherein inducing stirring in the internal molten core comprises dynamically adjusting an intensity of stirring based on the temperature measurements.

10. The method of claim 1, wherein the transition location is selected such that the plane intersects the embryonic ingot at a cross section where the external solid shell of the embryonic ingot occupies approximately one third of a line extending from the outer surface to a center of the embryonic ingot within the plane.

11. The method of claim 1, wherein the transition location is selected such that the plane intersects the embryonic ingot at a cross section where the external solid shell of the embryonic ingot occupies no more than 50% of a line extending from the outer surface to a center of the embryonic ingot within the plane.

12. A method, comprising:

forming an embryonic ingot by supplying molten metal to a mold and extracting heat from the molten metal to form an external solid shell, wherein the molten metal is a 7xxx series aluminum alloy;

solidifying an internal molten core of the embryonic ingot as the embryonic ingot is advanced in a direction of advancement away from the mold and additional molten metal is supplied to the mold, wherein solidifying the internal molten core comprises extracting heat from the internal molten core through the external solid shell; and continuously forming a high-strength zone within the external solid shell at a cross section of the embryonic ingot that is perpendicular to the direction of advancement and that intersects the internal molten core, wherein the high-strength zone is located between an outer surface of the external solid shell and the internal molten core, and wherein forming the high-strength zone includes reheating the external solid shell at the cross section to induce dispersoid precipitation in the external solid shell, wherein reheating the external solid shell at the cross section comprises reheating a portion of the external solid shell to a temperature suitable for precipitating dispersoids, wherein the temperature is lower than a homogenizing temperature of the molten metal and is between 400° C. and 420° C., and wherein the method further comprises maintaining the temperature at the portion of the external solid shell for at least 3 hours.

13. The method of claim 12, wherein the temperature, in Celsius, is between 80% and 98% of the homogenizing temperature, in Celsius, of the molten metal.

14. The method of claim 12, wherein the temperature, in Celsius, is between 85% and 90% of the homogenizing temperature, in Celsius, of the molten metal.

15. The method of claim 12, further comprising maintaining the temperature at the portion of the external solid shell for 3 hours to 10 hours.

16. The method of claim 12, wherein extracting heat from the internal molten core through the external solid shell comprises supplying liquid coolant to the outer surface of the external shell, and wherein reheating the external solid shell comprises removing the liquid coolant from the outer surface of the external solid shell.

17. The method of claim 16, wherein reheating the external solid shell further comprises applying heat to the outer surface of the external solid shell to supplement latent heating from the internal molten core.

18. The method of claim 12, further comprising:

taking temperature measurements of the embryonic ingot; and dynamically adjusting a distance between the mold and the cross section based on the temperature measurements.

19. The method of claim 12, further comprising:

inducing stirring in the internal molten core adjacent an interface between the internal molten core and the external solid shell.

20. The method of claim 19, further comprising taking temperature measurements of the embryonic ingot, wherein inducing stirring in the internal molten core comprises dynamically adjusting an intensity of stirring based on the temperature measurements.

21. The method of claim 12, wherein, at the cross section, the external solid shell of the embryonic ingot occupies approximately one third of a line extending from the outer surface to a center of the embryonic ingot.

22. The method of claim 12, wherein, at the cross section, the external solid shell of the embryonic ingot occupies no more than 50% of a line extending from the outer surface to a center of the embryonic ingot.

23. The method of claim 12, wherein the high-strength zone includes a higher concentration of dispersoids than a remainder of the external solid shell.

* * * * *